US010018949B2

(12) United States Patent
Shimomura et al.

(10) Patent No.: US 10,018,949 B2
(45) Date of Patent: Jul. 10, 2018

(54) IMAGE FORMING APPARATUS

(71) Applicant: Oki Data Corporation, Tokyo (JP)

(72) Inventors: Tatsuhiko Shimomura, Tokyo (JP); Yoichi Hayakawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/464,107

(22) Filed: Mar. 20, 2017

(65) Prior Publication Data

US 2017/0277094 A1 Sep. 28, 2017

(30) Foreign Application Priority Data

Mar. 24, 2016 (JP) ..... 2016-060760

(51) Int. Cl.
*G03G 15/00* (2006.01)

(52) U.S. Cl.
CPC ..... *G03G 15/50* (2013.01)

(58) Field of Classification Search
CPC ..... G03G 15/50
See application file for complete search history.

(56) References Cited

U.S. PATENT DOCUMENTS

2012/0274992 A1* 11/2012 Suzuki ..... G03G 21/1657 358/474
2013/0108282 A1* 5/2013 Sonoda ..... G03G 15/0863 399/12

FOREIGN PATENT DOCUMENTS

JP 2012230237 A 11/2012

* cited by examiner

*Primary Examiner* — Clayton E Laballe
*Assistant Examiner* — Jas Sanghera
(74) *Attorney, Agent, or Firm* — Muncy, Geissler, Olds & Lowe, P.C.

(57) ABSTRACT

An image forming apparatus includes a development unit having a first wireless communication part, a developer cartridge having a second wireless communication part and an antenna part that communicates with the first and second wireless communication parts. When the first and second wireless communication parts are respectively accommodated in holding parts, the first wireless communication part is closer to the antenna part than the second wireless communication part is, and the second wireless communication part and the first wireless communication part oppose each other.

15 Claims, 14 Drawing Sheets

(A) 1st Wireless Tag (B) 2nd Wireless Tag

IMAGE FORMING APPARATUS

CROSS REFERENCE TO RELATED APPLICATION

This application claims priority under 35 USC 119 to Japanese Patent Application No. 2016-060760 filed on Mar. 24, 2016 original document, the entire contents which are incorporated herein by reference.

TECHNICAL FIELD

This invention relates to an image forming apparatus and can preferably be applied to an electrophotographic image forming apparatus (so-called a printer) for example.

BACKGROUND

Conventionally, proposed as an image forming apparatus is the one, for example, that forms a toner image with a toner as an image carrier in an image forming part, carries a sheet as a medium by a carrying part, has the toner image transferred to the sheet in a transfer part, and fuses it by applying heat and a pressure to this sheet, thereby printing an image.

Among these, the image forming part is configured in a freely detachable manner from the chassis of the image forming apparatus, and there is one where a toner cartridge containing the toner to be consumed is attached to a development unit incorporating a consumable photosensitive drum, etc. for example.

As this image forming part, that is, the development unit and the toner cartridge, there is one incorporating a memory part that stores and updates information for judging compatible models, managing the degree of consumption, etc. Also, among image forming apparatuses, there is one that utilizes wireless communication for exchanging information with this memory part.

For example, the image forming apparatus can incorporate a small wireless tag that is a combination of the memory part and the wireless communication part into each of the development unit and the toner cartridge and perform wireless communication with an antenna incorporated in the image forming apparatus side to read or update information stored in each wireless tag.

Also, among the image forming apparatuses, proposed is the one that disposes the wireless tag of the development unit and the wireless tag of the toner cartridge partially overlap with each other and performs wireless communication between one antenna of the image forming apparatus side and both of the wireless tags to suppress the number of necessary antennas to the minimum (see Patent Document 1 for example).

RELATED ART

[Patent Doc. 1] JP Laid-Open Patent Publication 2012-230237, see FIG. 12

By the way, stored in the above-mentioned wireless tag of the development unit are information on the supported models of the image forming apparatus, and information indicating the degree of consumption of the photosensitive drum, etc. Also, stored in the wireless tag of the toner cartridge are information on the compatible models of the image forming apparatus, information indicating the degree of consumption of the toner, etc.

That is, the image forming apparatus can judge whether the system is normal or not by reading information on the compatible models for example, and judge whether a print process is possible or not by reading the degree of consumption of the photosensitive drum and the degree of consumption of the toner through communication with the wireless tags via the antenna and reading the stored information.

Also, the image forming apparatus can judge the presence/absence of the development unit and the toner cartridge from the state of wireless communication with the antenna and the wireless tags. For example, if wireless communication could not be performed between the antenna and the wireless tag of the development unit, the image forming apparatus judges that the development unit is not attached, refrains from performing a print process, and prompts the user to attach the development unit through a designated display part or the like.

However, this image forming apparatus disposes the wireless tag of the toner cartridge in a relatively close position and the wireless tag of the development unit in a relatively far position when viewed from the antenna. Therefore, in the image forming apparatus, communication failures in wireless communication between the antenna and the wireless tags tend to occur more easily in the development unit side than in the toner cartridge side.

In the image forming apparatus, there was a problem that when a communication failure has occurred between the wireless tag of the development unit and the antenna, despite having the development unit properly attached, printing could not be performed, and availability declined.

This invention was made considering the above point and attempts to propose an image forming apparatus that can enhance availability with a simple configuration.

SUMMARY

An image forming apparatus, disclosed in the application, includes a development unit that generates a toner image with a developer, a first wireless communication part that is connected to a first memory part storing information on the development unit, a first holding part that is provided on the development unit and holds the first wireless communication part, a developer cartridge that is detachable from the development unit, contains the developer, and supplies the developer to the development unit, a second wireless communication part that is connected to a second memory part storing information on the developer cartridge, a second holding part that is provided on the developer cartridge and holds the second wireless communication part, and an antenna part that communicates with the first and second wireless communication parts. When the first and second wireless communication parts are respectively accommodated in the first and second holding parts, the developer cartridge is attached to the developer unit, and the development unit is installed in a predetermined installation place that is in the image forming apparatus, the first wireless communication part is closer to the antenna part than the second wireless communication part is, and the second wireless communication part and the first wireless communication part oppose each other.

This invention can perform wireless communication in a state where a first wireless communication part is placed closer to an antenna part than a second communication part is. Thereby, this invention can greatly enhance the possibility to perform normal wireless communication between the antenna part and the first wireless communication part and significantly suppress the occurrences of a problem that an image forming process cannot be performed due to communication abnormality despite having a proper development unit attached.

This invention can realize an image forming apparatus that can enhance availability with a simple configuration.

BRIEF DESCRIPTIONS OF THE DRAWINGS

DETAILED DESCRIPTIONS OF PREFERRED EMBODIMENTS

Below, modes for implementing the invention (hereafter called embodiments) are explained referring to drawings.

1. First Embodiment

1-1. Configuration of the Image Forming Apparatus

Figure 1:
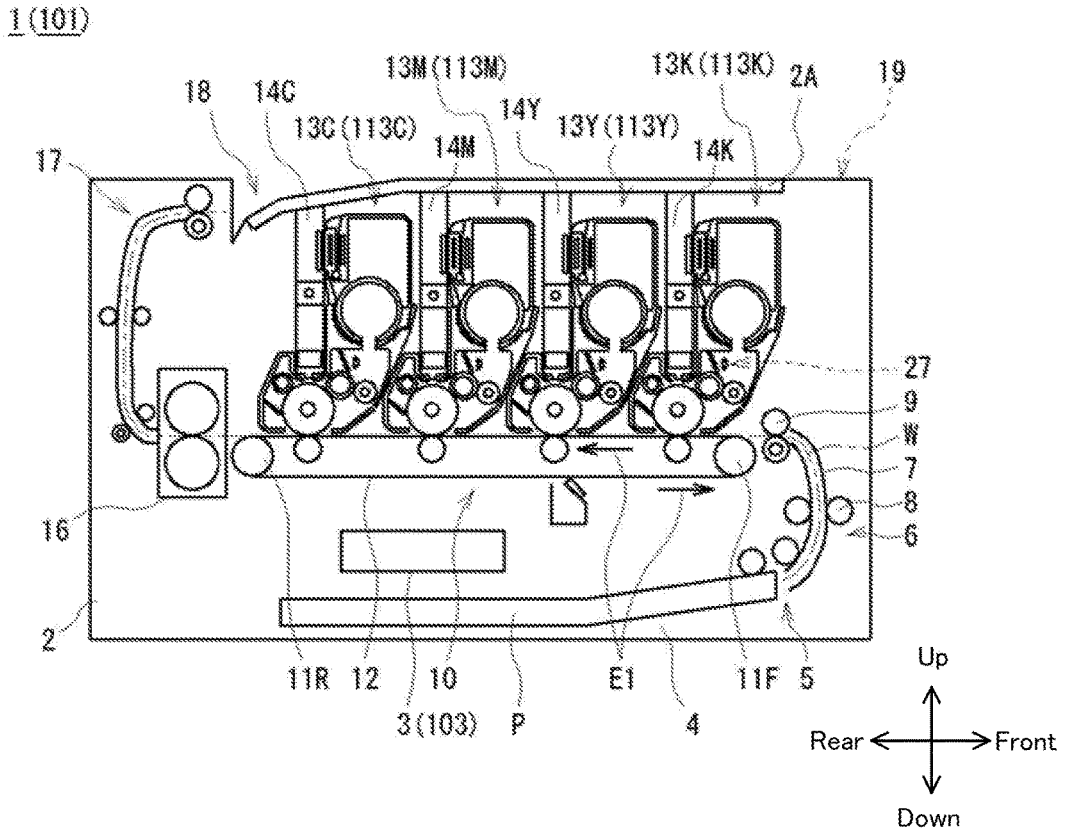
FIG. 1 is a schematic diagram showing the configuration of an image forming apparatus.

As the left side view is shown in FIG. 1, an image forming apparatus 1 is a color electrophotographic printer designed to print a desired color image on a sheet P. This image forming apparatus 1 has various kinds of parts disposed inside a chassis 2 formed in an approximate box shape. Also, the chassis 2 has a ceiling plate 2A that is its upper face part configured openable. Below, explanations are given by regarding the right end part in FIG. 1 as the front face of the image forming apparatus 1, and defining the up-down direction, the right-left direction, and the front-rear direction when viewed facing with this front face.

This image forming apparatus 1 is designed to control the whole in an integrated manner by a control part 3 provided inside the chassis 2. The control part 3 is configured centering on an unshown CPU (Central Processing Unit), and performs various kinds of processes concerning printing by reading predetermined programs from an unshown ROM (Read Only Memory), a flash memory, or the like and executing them. Also, the control part 3 internally has a memory part comprising a RAM (Random Access Memory), a hard disk drive, a flash memory, etc., and has this memory part store various kinds of information.

Provided on the upper face of the chassis 2 is a display part 19 that is made of a display device such as a liquid crystal panel for example and displays information in characters, images, etc. based on the control by the control part 3. Also, provided in the lowest part inside the chassis 2 is a sheet feeding cassette 4 that contains the sheet P that is a paper leaf medium. The sheet feeding cassette 4 is formed, for example, in a hollow rectangular parallelepiped shape with its upper face open. Incidentally, the sheet P is so-called cut paper that is cut into A4 size for example.

Provided in the front-upward of the sheet feeding cassette 4 is a sheet forwarding part 5. The sheet forwarding part 5 is configured of multiple rollers, an unshown sheet feeding motor, etc. By rotating appropriately each of the rollers, this sheet forwarding part 5 separates only the uppermost one piece of the sheet P from the rest of the sheet P contained in the sheet feeding cassette 4, and forwards it in the obliquely front-upward direction.

Provided in the front side through the upper side of the sheet forwarding part 5 is a lower carrying part 6 that carries the sheet P. The lower carrying part 6 forms a carrying route W where the sheet P handed over from the sheet forwarding part 5 is advanced in the front-upward direction and later turned toward the rear by a carrying guide 7 that guides the sheet P. Also, provided in the lower carrying part 6 are carrying roller pairs 8 and 9, each of which is made of two carrying rollers opposing each other through the carrying route W. By rotating the carrying rollers, the carrying roller pairs 8 and 9 carry the sheet P upward, then send it toward the rear along the carrying route W, and hand it over to a middle carrying part 10 positioned above the sheet feeding cassette 4.

The middle carrying part 10 has a carrying belt 12 made of an endless belt stretched so as to go around pulleys 11F and 11R disposed in the front side and the rear side. The upper side of the carrying belt 12 constitutes the carrying route W along the front-rear direction. Once the pulley 11R is rotated by a drive force from an unshown motor, this carrying belt 12 runs along the direction indicated with an arrow E1. That is, once the sheet P is forwarded from the lower carrying part 6, the middle carrying part 10 places it on the upper side of the carrying belt 12 and carries it toward the rear along the carrying route W.

Disposed in the upper side of the middle carrying part 10 are four image forming parts 13K, 13Y, 13M, and 13C (hereafter collectively called image forming parts 13) arranged sequentially from the front side toward the rear side. Although the image forming parts 13 correspond to black (K), yellow (Y), magenta (M), and cyan (C) colors, respectively, they are configured in the same manner except for the corresponding color.

On the other hand, on the ceiling plate 2A of the chassis 2, head holders 14K, 14Y, 14M, and 14C (hereafter collectively called head holders 14) are provided vertically in four places corresponding to the image forming parts 13. Each of the image forming parts 13 is disposed adjacent to or contacting with the front face, lower face, and the lower end vicinity of the rear face of each of the head holders 14.

Figure 2:
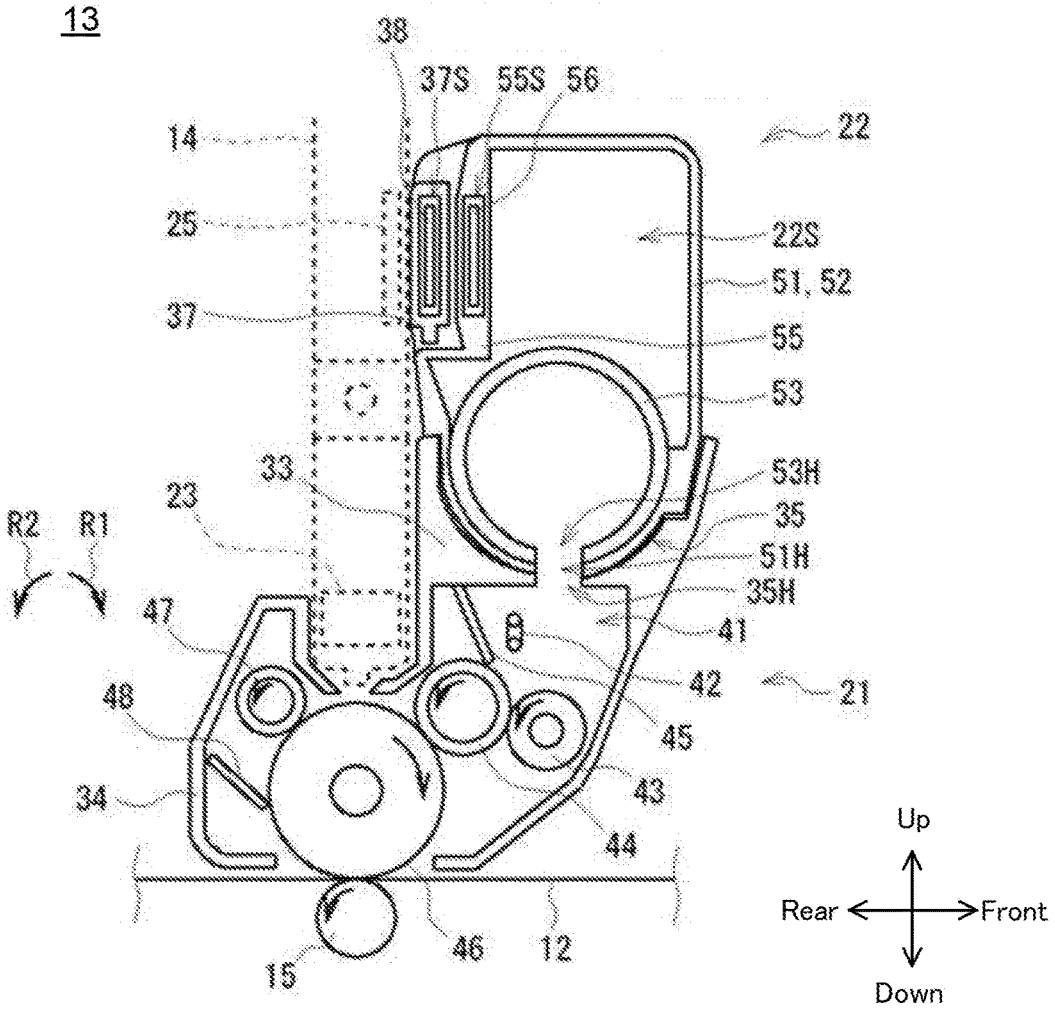
FIG. 2 is a schematic diagram showing the configuration of an image forming part by the first embodiment.

As an expanded view is shown in FIG. 2, each of the image forming parts 13 is configured of a development unit 21 that occupies the lower part and forms a toner image, and a toner cartridge 22 that is attached to its upper side and contains a toner as a developer. Also, near the lower end of the head holder 14, an LED (Light Emitting Diode) head 23 is incorporated. These image forming parts 13 are configured in such a manner that they can be attached to or detached from the chassis 2, that is, freely detachable, and are installed in their respective installation places provided inside the chassis 2.

Figure 3:
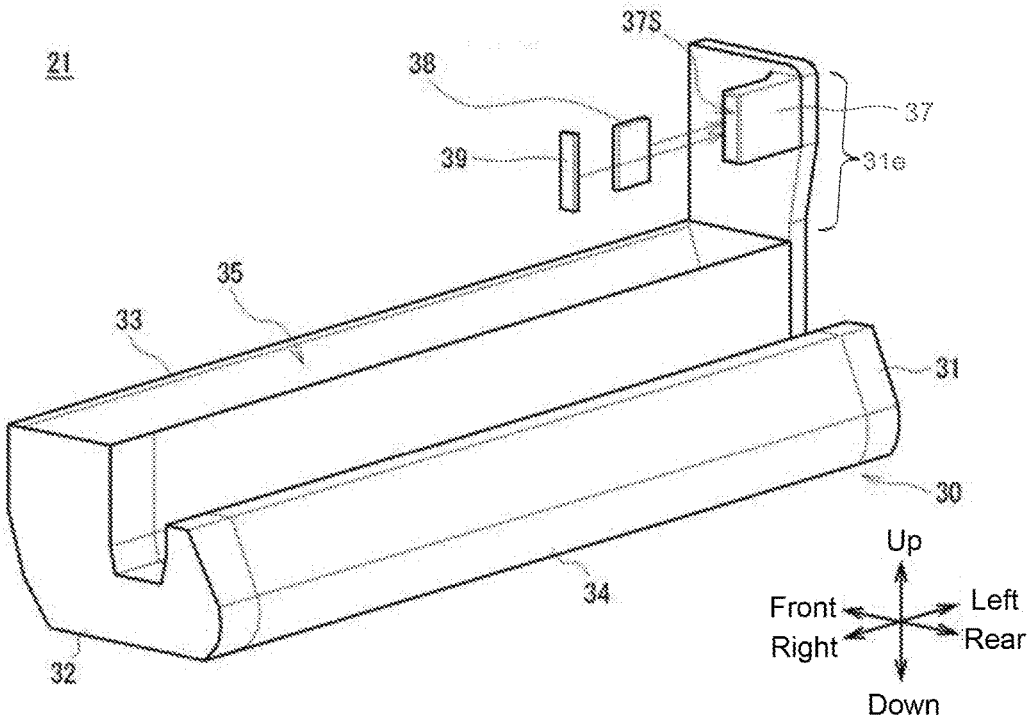
FIG. 3 is a schematic perspective diagram showing the configuration of a development unit by the first embodiment.

As a perspective view is shown in FIG. 3, the development unit 21 has a three-dimensional shape elongated in the right-left direction as the whole, which is a shape that covers the front side, the lower side, and the part in the lower end vicinity of the rear side of the head holder 14 (FIG. 2).

This development unit 21 forms an internal space by surrounding it with a left side plate 31 constituting the left end part, a right side plate 32 constituting the right end part, an upper frame 33 constituting the upper part, and a base frame 34 constituting the lower part.

Figure 4:
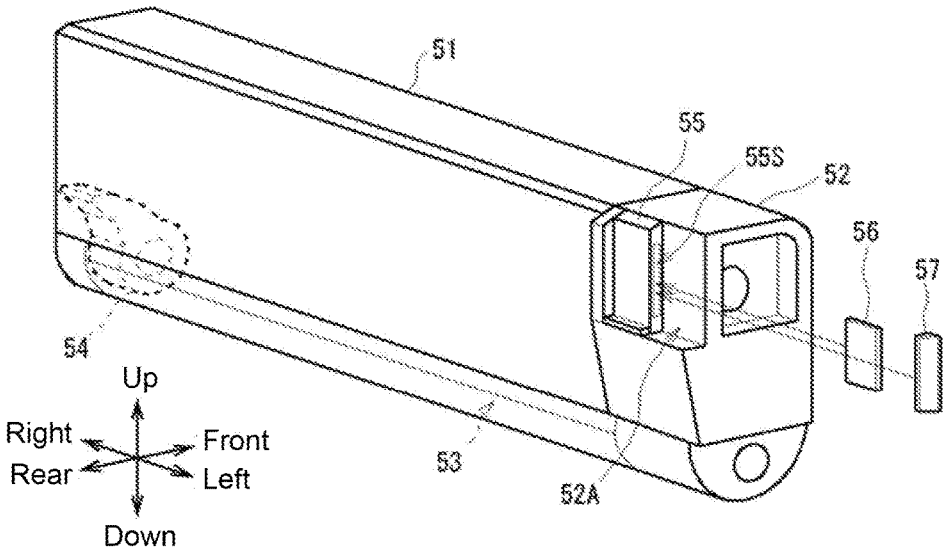
FIG. 4 is a schematic perspective diagram showing the configuration of a toner cartridge by the first embodiment.

Provided in the upper part near the front of the upper frame 33 is a toner cartridge attaching part 35 having its upper part open. This toner cartridge attaching part 35 (FIG. 2) is formed in a shape that is hollowed out downward in a semicircular shape when viewed from the right-left direction, and the lower end part of the toner cartridge 22 shown in FIG. 4 is fitted in (the details are mentioned below). Also, drilled on the bottom part of the toner cartridge attaching part 35 (FIG. 2) is a passing hole 35H for having the toner pass downward from the toner cartridge 22, that is, for supplying the toner to the development unit 21.

Formed below the toner cartridge attaching part 35 in the development unit 21 is a toner storage chamber 41 (or developer storage chamber) that stores the toner supplied from the toner cartridge 22. Provided inside this toner storage chamber 41 is a toner stored amount detection part 42 that detects the remaining amount of toner stored (that is, held).

The toner stored amount detection part 42 is configured of a detection body configured in a freely rotatable manner, and a bias body that rotates at a constant rotation speed and biases the detection body in the rotation direction when in contact with it inside the toner storage chamber 41. This detection body is pushed up by the bias body and rotates at a constant speed, and once it reaches the top dead center, it starts a free fall. Afterward, upon reaching the upper face of the toner stored in the toner storage chamber 41, because the toner becomes a load, the detection body remains still in that position. Further, once it is caught up with the bias body rotating at the constant speed, the detection body resumes its rotation at the constant speed together with the bias body.

Therefore, in the toner stored amount detection part 42, the length of time when the detection body remains still differs according to the amount of toner stored in the toner storage chamber 41. For example, if the amount of toner stored in the toner storage chamber 41 is relatively large, time when the detection body remains still becomes relatively short. On the other hand, if the amount of toner stored in the toner storage chamber 41 is relatively small, time when the detection body remains still becomes relatively long.

Then, provided inside the chassis 2 of the image forming apparatus 1 (FIG. 1) are toner remaining amount sensors 27, each of which is made of an optical sensor, in places corresponding to the toner stored amount detection parts 42. Each of the toner remaining amount sensors 27 as a remaining amount detection part optically detects the rotation state of the detection body in each of the toner stored amount detection parts 42, and reports the obtained detection result to the control part 3. Based on the detection result obtained from the toner remaining amount sensor 27, the control part 3 can detect the amount of toner stored in the toner storage chamber 41, that is, the toner remaining amount.

Also, provided inside the development unit 21 (FIG. 2) are a supply roller 43, a development roller 44, a photosensitive drum 46, a charging roller 47, and a cleaning blade 48, etc., which are supported from the left and the right by the left side plate 31 and the right side plate 32 (FIG. 3). The supply roller 43, the development roller 44, and the charging roller 47 are all formed in a cylindrical shape aligning their respective central axes along the right-left direction, and can rotate in the direction of an arrow R2 that is the anticlockwise direction in the figure centering on their respective central axes to have their respective circumferential side faces charged. The supply roller 43 has its circumferential side face contact with the development roller 44. The development roller 44 has its circumferential side face contact with the supply roller 43, a development blade 45, and the photosensitive drum 46.

The development blade 45 is supported by the upper frame 33, is made of a metallic material of a plate shape elongated in the right-left direction, and has its long edge contact with the circumferential side face of the development roller 44 by utilizing elastic deformation. The photosensitive drum 46 is disposed right under the LED head 23, is formed in a cylindrical shape aligning its central axis to the right-left direction in the same manner as the supply roller 43, etc., and rotates in the direction of an arrow R1 centering on this central axis. On the circumferential side face of the photosensitive drum 46, a photosensitive material is applied.

The photosensitive drum 46 has its circumferential side face contact with the development roller 44 and the charging roller 47. Also, disposed adjacently under the photosensitive drum 46 is a transfer roller 15. That is, the photosensitive drum 46 is in a state of sandwiching the transfer belt 12 between it and the transfer roller 15. The transfer roller 15 is designed to be able to have its circumferential side face charged and rotates in the arrow R2 direction.

The LED head 23 has multiple LED elements aligned along the right-left direction, and is designed to have the LED elements emit light in an emission pattern based on the control by the control part 3. Also, the LED head 23 incorporates a lens that condenses light, and its attaching position is adjusted so as to focus light emitted from the LED elements onto the surface of the photosensitive drum 46.

When forming a toner image, based on the control by the control part 3 (FIG. 1), the development unit 21 rotates the photosensitive drum 46 in the arrow R1 direction, and rotates the supply roller 43, the development roller 44, the charging roller 47, and the transfer roller 15 in the arrow R2 direction. Also, the carrying belt 12 runs toward the rear.

Further, the development unit 21 charges the supply roller 43, the development roller 44, the development blade 45, and the charging roller 47 by applying their respective predetermined bias voltages. By this charging, the supply roller 43 has the toner inside the toner storage chamber 41 adhere to its circumferential side face, and has this toner adhere to the circumferential side face of the development roller 44 by rotating. The rotating development roller 44 has its excess toner removed from its circumferential side face by the development blade 45, thereby having the toner adhere in a uniform thin film shape of a predetermined film thickness, and then has this circumferential side face contact with the circumferential side face of the photosensitive drum 46.

On the other hand, the charging roller 47 contacts with the photosensitive drum 46 in a charged state, thereby uniformly charging the contact place on the circumferential side face of the photosensitive drum 46. The LED head 23 emits light in an emission pattern based on image data supplied from the control part 3 (FIG. 1), thereby exposing the circumferential side face of the photosensitive drum 46. Thereby, the photosensitive drum 46 has an electrostatic latent image formed based on the image data in the upper end vicinity of the circumferential side face.

Subsequently, the photosensitive drum 46, accompanying its rotation in the arrow R1 direction, has the place with the electrostatic latent image formed contact with the development roller 44 in order. Thereby, the photosensitive drum 46 has the toner transferred from the circumferential side face of the development roller 44, and continues to develop the toner image based on the electrostatic latent image on the circumferential side face. Further, by rotating in the arrow R1 direction, the photosensitive drum 46 advances the developed toner image to the lower end, that is, the place contacting with the sheet P carried by the carrying belt 12, and has the toner image transferred from its circumferential side face to the sheet P by the charge of the transfer roller 15.

A fuser part 16 (FIG. 1) rotates two fuser rollers disposed in the upper side and the lower side of the carrying route W in their respective designated directions, fuses the toner image by applying heat and a pressure to the sheet P by heating an internal heater, and hands it over to an upper carrying part 17 in the rear. Thereby, formed on the sheet P is an image based on the image data. The upper carrying part 17 is configured of the carrying guide and the carrying roller that advances the sheet P disposed so as to sandwich the carrying route W, carries the sheet P in the rear-upward direction along the carrying route W, afterward discharges it forward, and accumulate it on a stacker part 18 formed on the upper face of the chassis 2.

1-2. Configuration of the Image Forming Part

Next, explained is the configuration of the image forming part 13. As mentioned above, the image forming part 13 is designed to allow the toner cartridge 22 (FIG. 4) as a developer cartridge to be attached to or detached from the upper front of the development unit 21 (FIG. 3).

Figure 6:
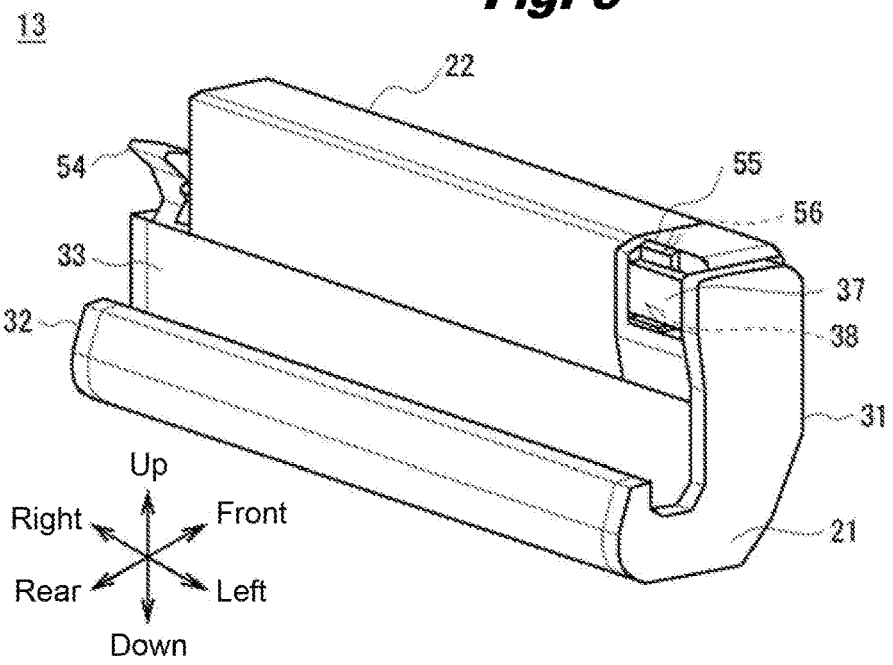
FIG. 6 is a schematic perspective diagram showing the configuration of the image forming part by the first embodiment.

The left side plate 31 of the development unit 21 (FIG. 3) has an extending portion 31*e*, which extends upward and projects in comparison with right side plate 32. The extending portion 31*e* is arranged at the front side (or backward in the drawing view) in the left side plate 31. As illustrated in FIG. 6, when the development unit 21 is assembled to the toner cartridge 22, the extending portion 31*e* matches with the left side of the cartridge, covering the left side. In other words, the extending portion 31*e* has a shape to be positioned at the left side of the toner cartridge 22 such that the portion is to be added to the left side (or to become a part of the left side) when the development unit 21 is assembled.

Disposed inside the left side plate 31 are multiple cogwheels engaged with one another. In a state where the image forming part 13 is attached to the chassis 2 (FIG. 1), this left side plate 31 receives the supply of a drive force from a drum motor (not shown) provided inside the chassis 2 through a designated cogwheel, and transmits it through the internal cogwheels, etc. as necessary, thereby rotating the photosensitive drum 46, the supply roller 43, etc. mentioned above.

In the rear end vicinity of the right side face of the upper part of this left side plate 31, a first tag holding part 37 is erected rightward. The first tag holding part 37 as a first holding part is configured in a flat (depressed) rectangular parallelepiped shape that is thin in the front-rear direction as the whole. This first tag holding part 37 has a containing space 37S formed inside, and its right side face is open. Incidentally, the first tag holding part 37 is configured of a predetermined resin material, for example, so that electromagnetic waves are transmitted well.

Contained in the containing space 37S is a first wireless tag 38 as the first wireless communication part. The first wireless tag 38 is configured in a thin rectangular parallelepiped shape or a thin plate shape that is thin in the front-rear direction as the whole, incorporating an antenna, etc. for performing wireless communication. Therefore, the inner dimensions of this containing space 37S are appropriately determined according to the size of this first wireless tag 38.

Attached on the left side face of the first tag holding part 37 is a tag holding lid body 39. The tag holding lid body 39 has approximately the same up-down and front-rear direction lengths as those of the first tag holding part 37 and a sufficiently short right-left direction length. This tag holding lid body 39 can hold the first wireless tag 38 inside the containing space 37S by being fixed to the left side face of the first tag holding part 37 in a state where the first wireless tag 38 is contained in the containing space 37S.

On the other hand, the toner cartridge 22 (FIG. 4) is formed in a rectangular parallelepiped shape that is long in the right-left direction as the whole, and its lower part is formed in a semicircular shape when viewed along the right-left direction, that is, in the same manner as the lower part of the cylinder along the right-left direction (FIG. 2). Together with an outer frame 51 constituting the major part of the outer circumference and a side frame 52 connected to the left end part of the outer frame 51, this toner cartridge 22 is configured so as to form a toner containing space 22S that contains the toner as the developer inside.

The outer frame 51 is made of a predetermined resin material, forms the central part through the right side part of the toner containing space 22S, and leaves the left side open. Also, provided in the vicinity of the bottom part of the outer frame 51, that is, the lower end of the part formed in a semicircular shape when viewed along the right-left direction is a toner supply hole 51H. It is designed so that when the toner cartridge 22 is attached to the development unit 21 (FIG. 2), this toner supply hole 51H is positioned approximately right above the passing hole 35H of the toner cartridge attaching part 35.

The lower part of the outer frame 51 is formed as if it were the lower half of a cylindrical shape along the right-left direction. Also, on the lower part of the right face of the outer frame 51, a round hole having a relatively large diameter is drilled. A semicylindrical opening/closing body 53 is inserted through this round hole. The semicylindrical opening/closing body 53 is configured of about a half of a cylinder along the right-left direction and annular parts attached to both of its right and left ends, and internally contacts with the lower cylindrical part of the outer frame 51 (FIG. 2). Also, the semicylindrical opening/closing body 53 has a slit-shape hole part 53H formed along the right-left direction in a designated place of its annular part.

Further, attached to the right end of the semicylindrical opening/closing body 53 is a lever 54 (FIG. 4). Once a force is applied in the rotation direction centering on the central axis along the right-left direction, this lever 54 has the semicylindrical opening/closing body 53 rotate while sliding with the lower cylindrical shape part of the outer frame 51. At this time, when the semicylindrical opening/closing body 53 superimposes the hole part 53H on the toner supply hole 51H of the outer frame 51, it makes the toner containing space 22S communicate with the lower space, and when it superimposes any other place than the hole part 53H on the toner supply hole 51H, it blocks the toner supply hole 51H.

Incidentally, when the toner cartridge 22 is detached from the development unit 21, this semicylindrical opening/closing body 53 blocks the toner supply hole 51H to retain the toner inside the toner containing space 22S.

The side frame 52 forms a part in the left end vicinity of the toner containing space 22S and also blocks the left side part of the outer frame 51. Provided on the upper part of the rear face of the side frame 52 is a second tag holding part 55 in a recess part 52A that is recessed forward from the rear face of the outer frame 51. The second tag holding part 55 as a second holding part is configured in a flat rectangular parallelepiped shape that is thin in the front-rear direction as the whole in the same manner as the first tag holding part 37 of the development unit 21 (FIG. 3). This second tag holding part 55 has a containing space 55S formed inside, and its left side face is open.

Contained in the containing space 55S is a second wireless tag 56 as a second wireless communication part (the details are mentioned below). Therefore, the inner dimensions of the containing space 55S are appropriately determined according to the size of this second wireless tag 56. Attached on the left side face of the second tag holding part 55 is a tag holding lid body 57. The tag holding lid body 57 has almost the same up-down and front-rear direction lengths as the second tag holding part 55, and its left side face is a slope surface connecting the front-left side and the rear-right side. This tag holding lid body 57 can hold the second wireless tag 56 inside the containing space 55S by being fixed to the right side face of the second tag holding part 55 in a state where the second wireless tag 56 is contained in the containing space 55S.

Figure 5A:
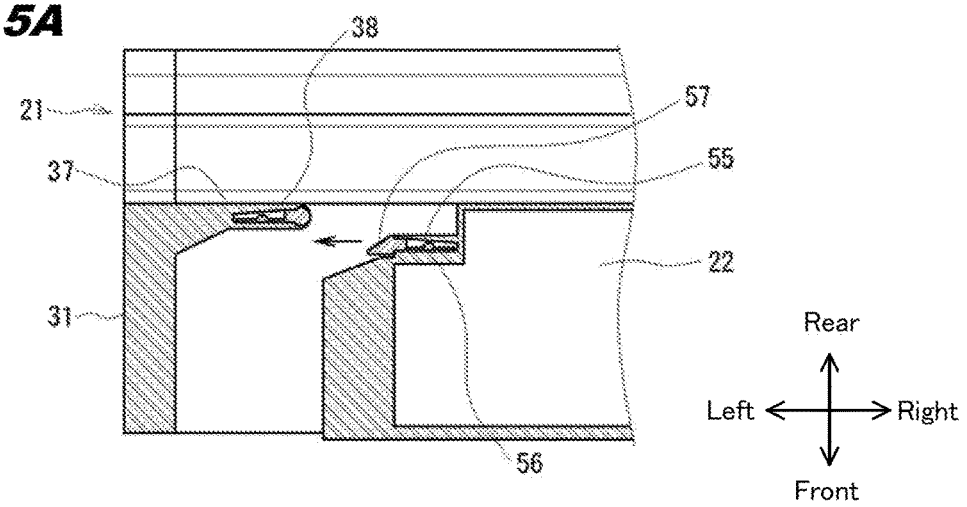
FIGS. 5A-5C are schematic diagrams showing the positions of wireless tags and an antenna part.

When being attached to the development unit 21, this toner cartridge 22 is positioned, as shown in FIG. 5A, so that the left side face of the toner cartridge 22 opposes the right side of the left side plate 31 in the development unit 21. At this time, the cylindrical part formed on the lower side of the toner cartridge 22 gradually enters the toner cartridge attaching part 35 from the left side.

Figure 5B:
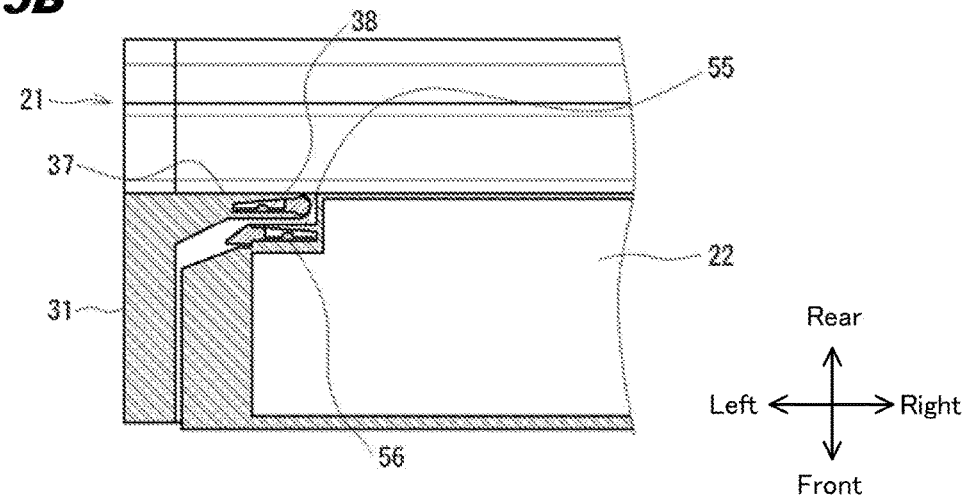

The second tag holding part 55 of the toner cartridge 22 is positioned mostly in the front side of the first tag holding part 37 of the development unit 21. In due course, as shown in FIG. 5B, the toner cartridge 22 has its left side face contact with the right side of the left side plate 31 in the development unit 21, and as shown in FIG. 6, has its cylindrical part on the lower side enter completely inside the toner cartridge attaching part 35.

Even if the rear face of the second tag holding part 55 is positioned in the rear side of the front face of the first tag holding part 37, by the slope surface formed on the tag holding lid body 57, the toner cartridge 22 gradually moves the rear face of the second tag holding part 55 forward and has it reach the front side of the front face of the first tag holding part 37. As the result, the first wireless tag 38 is positioned in the rear side of the second wireless tag, has a portion of it overlapped with the second wireless tag when viewed from the rear, and has the remaining portion stick out to the left side.

Further, by the lever 54 (FIG. 6) being rotated in a predetermined direction, the toner cartridge 22 has an unshown engagement latch engage with the development 21 side. Thereby, the toner cartridge 22 is fixed to and integrated with the development unit 21, and also has the hole part 53H of the semicylindrical opening/closing body 53 superimposed on the toner supply hole 51H to have the toner containing space 22S communicate with the toner storage chamber 41 of the development unit 21 (FIG. 2). Thereby, the toner cartridge 22 and the development unit 21 become the integrated image forming part 13. Besides, the toner cartridge 22 can be easily removed from the development unit 21 by rotating the lever 54 in the opposite direction of that for attaching it.

1-3. Configuration of the Wireless Tags and the Relation with the Antenna Part

Figure 7:
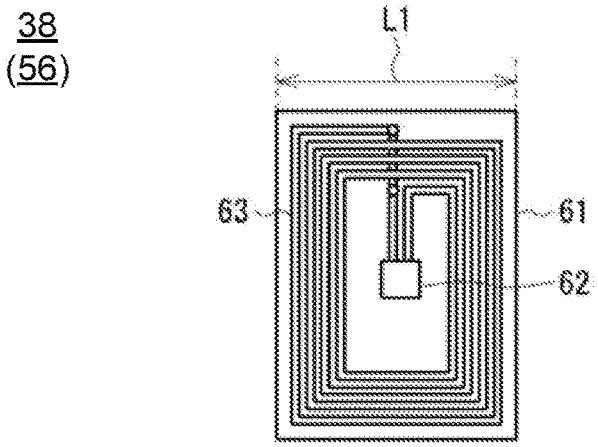
FIG. 7 is a schematic diagram showing the configuration of each of the wireless tags.

As shown in FIG. 7, the first wireless tag 38 is configured centering on a board 61 that is a printed wiring board of a thin plate or film shape. The right-left direction length of the board 61 is set to a length L1. Disposed near the center of the board 61 is an IC (Integrated Circuit) chip 62 that is a small semiconductor part, and an antenna 63 is disposed around it.

The antenna 63 is configured of a wiring pattern, goes around the IC chip 62 in a spiral shape, and is electrically connected with the IC chip 62. The antenna 63 sends or receives an electromagnetic wave of a designated high frequency. The IC chip 62 is provided with a wireless communication circuit that performs wireless communication, an arithmetic circuit that performs various kinds of computations, a memory part that stores various kinds of information, etc., and operates using as its power source the electric power generated by receiving the electromagnetic wave in the antenna 63.

Figure 8A:
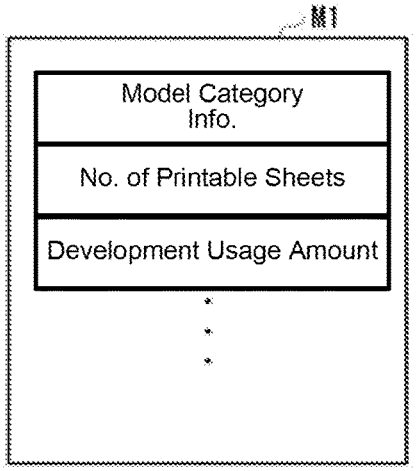
FIGS. 8A and 8B are schematic diagrams showing the memory contents of the wireless tags.

As shown in FIG. 8A, stored in the memory part of the IC chip 62 in the first wireless tag 38 (hereafter called the first memory part) is an information table M1 where various kinds of information on the development unit 21 are stored. Stored in this information table M1 are, for example, model category information indicating the models of the image forming apparatus 1 that are compatible with the development unit 21, the number of printable sheets that is the remaining quantity developable by the development unit 21 converted to the equivalent number of A4-size sheets, development unit usage amount indicating the accumulated value of the amount used since starting to use the development unit 21, etc.

Upon accepting an instruction to read information via the antenna 63, following this instruction, the arithmetic circuit of the IC chip 62 reads the information according to the instruction from the memory part, converts it into a wireless signal by the wireless communication circuit, and radiates an electromagnetic wave from the antenna 63. Also, upon receiving an instruction to write information and also the information to write through the antenna 63, following this instruction, the arithmetic circuit of the IC chip 62 writes the information to the memory part.

Figure 8B:
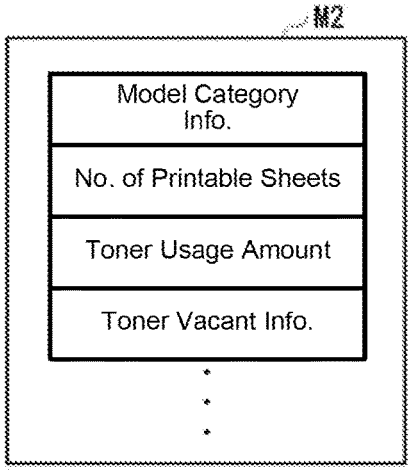

Although the second wireless tag 56 is configured of the board 61, the IC chip 62, and the antenna 63 in the same manner as the first wireless tag 38 (FIG. 7), the content stored in the memory part of the IC chip 62 is different from that of the first wireless tag 38. That is, as shown in FIG. 8B, stored in the memory part of the IC chip 62 in the second wireless tag 56 (hereafter called the second memory part) is an information table M2 where various kinds of information on the toner cartridge 22 are stored.

Stored in this information table M2 are, for example, model category information indicating the models of the image forming apparatus 1 that are compatible with the toner cartridge 22, and the number of printable sheets indicating the remaining quantity of toner images formable with the toner stored in the toner cartridge 22 converted to the equivalent number of A4-size sheets. Also, stored in the information table M2 are the toner usage amount indicating the accumulated value of the amount used since starting to use the toner cartridge 22, toner vacant information that indicates whether or not the toner in the toner cartridge 22 becomes empty, etc.

Incidentally, the toner usage amount is computed with high precision based on, for example, the area of the part where the toner was used, the set density at that time, etc. in each toner image formed. Therefore, the toner remaining amount obtained based on the toner usage amount in the information table M2 becomes more precise than the toner remaining amount obtained from the toner remaining amount sensor 27.

Figure 9:
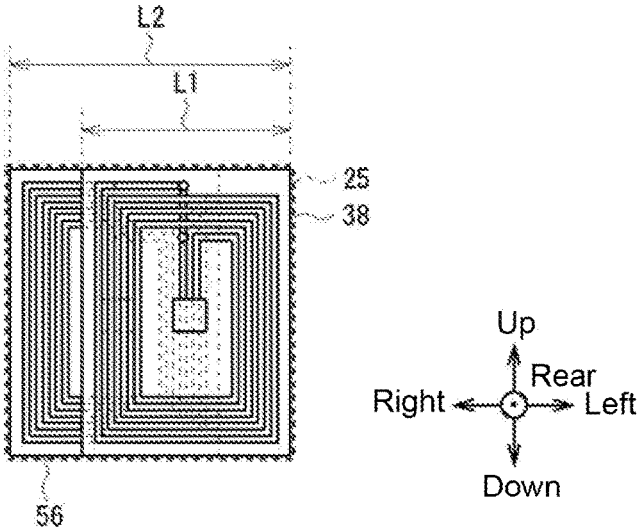
FIG. 9 is a schematic diagram showing an overlap between the wireless tags and the position of the antenna part.

By the way, in the image forming part 13 having the toner cartridge 22 attached to the development unit 21 (FIG. 6), as shown in FIG. 5B, the first wireless tag 38 is positioned in the rear side of the second wireless tag 56, and about a half of it on the right side is overlapped with the second wireless tag 56. When the first wireless tag 38 and the second wireless tag 56 are viewed from the rear, as shown in FIG. 9, they are in a state where the up-down direction positions are nearly aligned, and part of the antenna 63 in the second wireless tag 56 (FIG. 7) sticks out to the right side of the first wireless tag 38. Therefore, length L2 in the right-left direction of the first wireless tag 38 and the second wireless tag 56 combined is about 1.5 times the length L1 of one piece.

Figure 10:
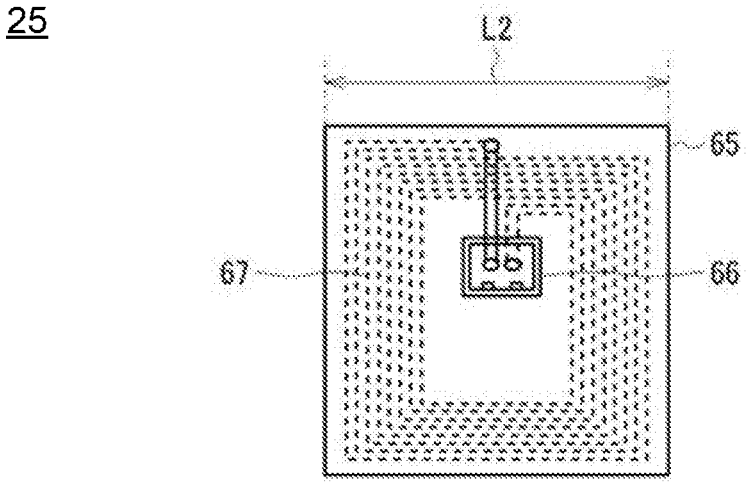
FIG. 10 is a schematic diagram showing the configuration of the antenna part.

On the other hand, attached to each of the head holders 14 (FIGS. 1 and 2) on the lower face of the ceiling plate 2A in the chassis 2 of the image forming apparatus 1 is an antenna part 25. As shown in FIG. 10, the antenna part 25 is configured of a base body 65 formed in a flat plate, an interface connector 66 for electrically connecting with other circuits, and an antenna 67 formed with a circuit pattern on the opposite side of the interface connector 66 on the base body 65. Also, the antenna part 25 has a right-left direction length equivalent to the length L2 when the first wireless tag 38 and the second wireless tag 56 are partially overlapped with each other (FIG. 9).

Figure 5C:
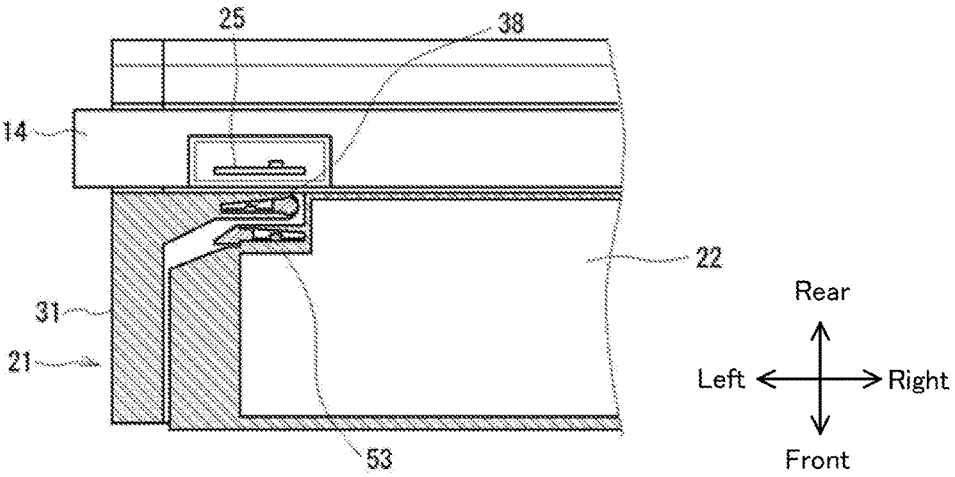

By having its attaching position to the head holder 14 appropriately set, as shown in FIGS. 2 and 5C, this antenna part 25 is positioned right behind the first wireless tag 38 and the second wireless tag 56 in a state where the image forming part 13 is properly attached to the chassis 2, and the ceiling plate 2A is closed.

That is, the first wireless tag 38 is disposed in a closer position to the antenna part 25 than the second wireless tag 56 is. Also, the antenna part 25 has the antenna 67 (FIG. 10) oppose almost the whole surface of the antenna 63 in the first wireless tag 38 (FIG. 7), and has the antenna 67 and part of the antenna 63 in the second wireless tag 56. Thereby, the antenna part 25 can perform extremely fine wireless communication with the first wireless tag 38, and perform sufficiently fine wireless communication with the second wireless tag 56.

In the embodiment, these antennas 63 of the first and second wireless tags are in identical shape.

Figure 11:
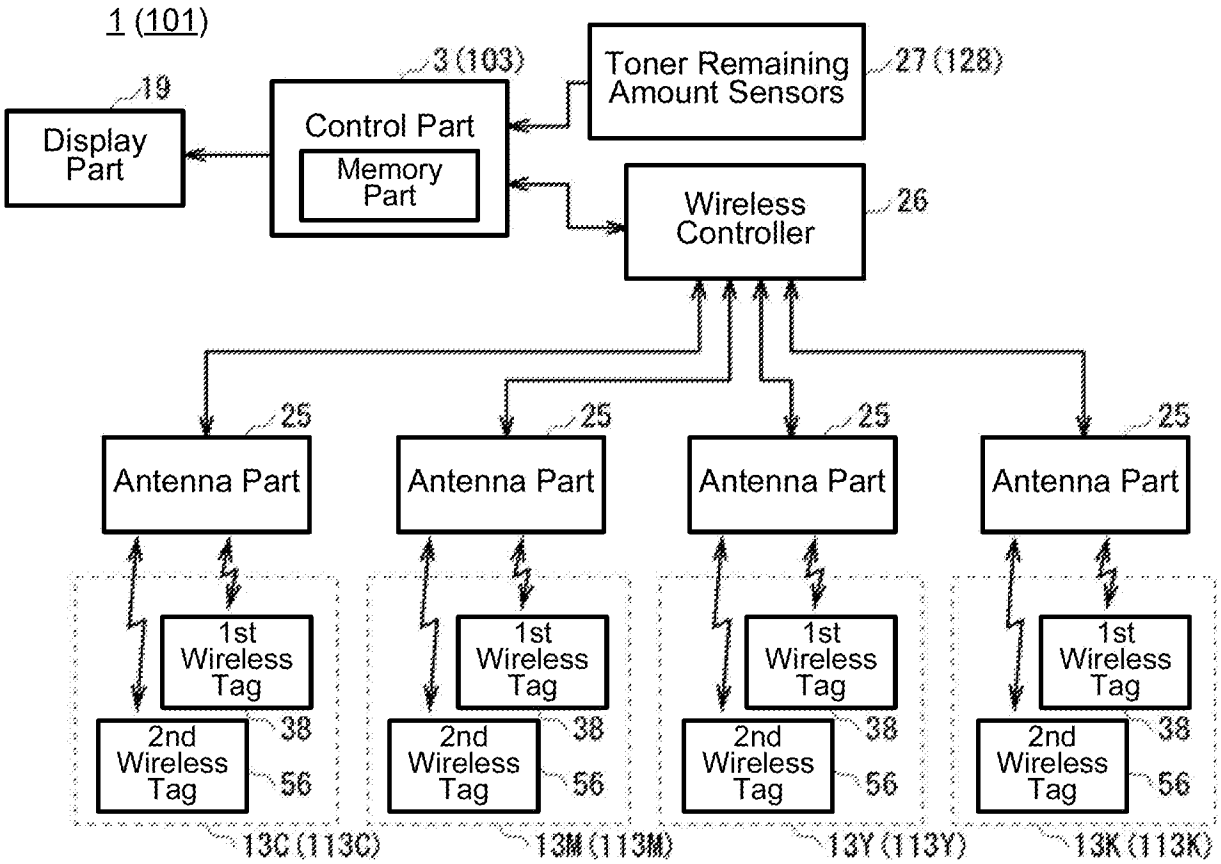
FIG. 11 is a schematic block diagram showing the circuit configuration of the image forming apparatus.

Here, as the circuit configuration of the image forming apparatus 1 is shown in FIG. 11, the antenna part 25 is provided on each of the head holders 14 in four places and connected to a wireless controller 26. The wireless controller 26 is wire-connected with the four antenna parts 25 and the control part 3, and once various kinds of control signals and electric power are supplied from the control part 3, supplies electric power to each antenna part 25 to have it radiate an electromagnetic wave, and obtains an electric signal based on the electromagnetic wave received by each antenna part 25.

Thereby, the control part 3 can perform communication processes with the first wireless tag 38 and the second wireless tag 56 through the wireless controller 26, read various kinds of information stored in the memory part of the IC chip 62, and also write various kinds of information to the memory part or update its contents. Incidentally, the control part 3 is also connected with the toner remaining amount sensor 27 that detects the toner remaining amount of the toner storage chamber 41 in the development unit 21, and the display part 19 provided on the top face of the chassis 2.

1-4. Operation State Judgement Process

By the way, in the image forming apparatus 1, if all the four detachable image forming parts 13 are properly attached, and the remaining amount of toner for every color is sufficient, an image based on image data can be printed on the sheet P, that is, a print process can be appropriately performed. On the other hand, in the image forming apparatus 1, if the image forming parts 13 are not properly attached, or the remaining amount of toner of any color is not sufficient, the print process cannot be appropriately performed.

Then, it is designed so that upon grasping the states of individual parts based on information obtained from various kinds of sensors, the communication states with the wireless tags, etc., the image forming apparatus 1 comprehensively judges the operation state indicating the print process availability, the presence/absence of abnormality, etc.

Figure 12:
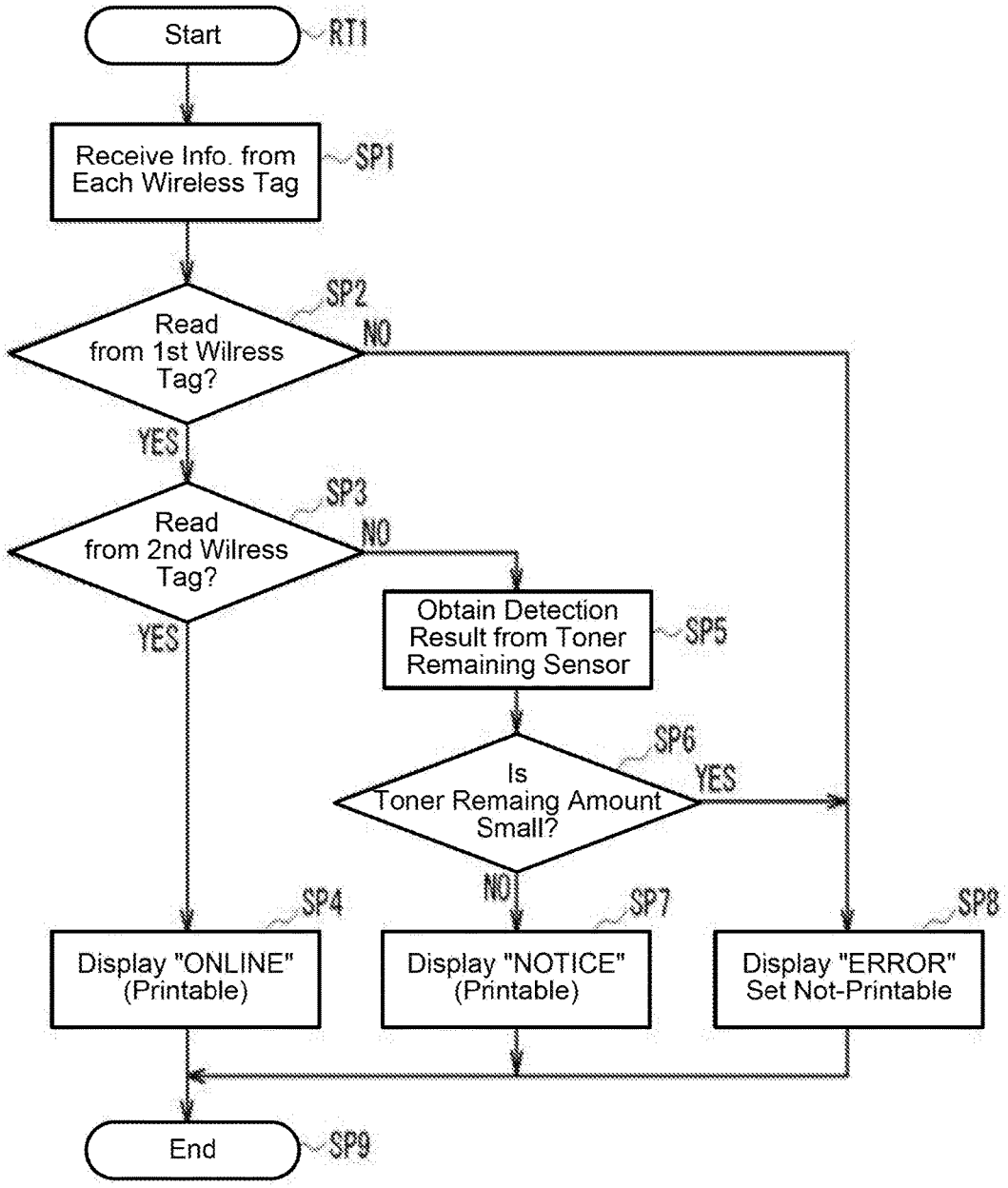
FIG. 12 is a flow chart showing an operation state judgement routine by the first embodiment.

Specifically, once the power is turned on, the control part 3 of the image forming apparatus 1 reads an operation state judgement program from the memory part and executes it, thereby starting an operation state judgement routine RT1 shown in FIG. 12 and moving on to SP1. In SP1, the control part 3 performs communication processes (or receive info.) with the first wireless tag 38 and the second wireless tag 56 of each color through the wireless controller 26 (FIG. 11), and moves on to the next SP2.

In SP2, the control part 3 judges whether various kinds of information could be read from the memory part of the first wireless tag 38 of each color. If a positive result is obtained here, it indicates that at least the development unit 21 of each color is properly attached to the chassis 2. At this time, the control part 3 moves on to the next SP3.

In SP3, the control part 3 judges whether various kinds of information could be read from the memory part of the second wireless tag 56 of each color. If a positive result is obtained here, it indicates that, the toner cartridge 22 in addition to the development unit 21 of each color is also properly attached to the chassis 2. At this time, the control part 3 moves on to the next SP4. In SP4, the control part 3 sets "Online" indicating that the print process is available as the operation state, displays it on the display part 19 (or Display "ONLINE"), and moves on to the next SP9, ending the operation state judgement routine RT1.

On the other hand, if a negative result is obtained in SP3, because information could not be read from the memory part of the second wireless tag 56, it indicates the possibility that the toner cartridge 22 is not attached and/or the possibility that although the toner cartridge 22 is attached, communication abnormality occurred. At this time, the control part 3 moves on to the next SP5.

In SP5, the control part 3 obtains a detection result from the toner remaining amount sensor 27, judges the toner remaining amount in the toner storage chamber 41 (FIG. 2) based on this detection result, and moves on to the next SP6. In SP6, the control part 3 judges whether the detected toner remaining amount is smaller than a predetermined threshold value. If a negative result is obtained here, it indicates that because a sufficient amount of toner remains in the toner storage chamber 41, even if the toner cartridge 22 is not attached, a print process can be performed. At this time, the control part 3 moves on to the next SP7.

In SP7, the control part 3 displays on the display part 19 a content notice that certain abnormality has occurred concerning the toner cartridge 22 (or Display "NOTICE"), sets the operation state that can perform a print process, and moves on to the next SP9, ending the operation state judgement routine RT1.

On the other hand, if a positive result is obtained in SP6, it indicates that because no sufficient amount of toner remains in the toner storage chamber 41, even if the toner cartridge 22 is attached, a normal print process cannot be performed. At this time, the control part 3 moves on to the next SP8.

Also, if a negative result is obtained in SP2, it indicates that there is a high possibility that the development unit 21 is not attached, or even if it is attached, it is possible that the photosensitive drum 46, etc. of the development unit 21 cannot be appropriately controlled, and a normal print process cannot be performed in any case. At this time, the control part 3 moves on to the next SP8.

In SP8, the control part 3 displays on the display part 19 as an error that the development unit 21 or the toner cartridge 22 is not attached, or that the toner remaining amount is not sufficient (or Display "ERROR), sets the operation state that cannot perform a print process (or set not-printable), and moves on to the next SP9, ending the operation state judgement routine RT1.

1-5. Effects, Etc.

In the configuration mentioned above, the image forming apparatus 1 by the first embodiment is designed so that when the image forming part 13 is configured by attaching the toner cartridge 22 to the development unit 21, the first wireless tag 38 of the development unit 21 is positioned in the rear side of the second wireless tag 56 of the toner cartridge 22 (FIG. 5B), and they are partially overlapped when viewed from the rear (FIG. 9). The view from the rear means a view perpendicularly oriented from a flat surface of the antenna part 25, which opposes to the first wireless tag 38, or a flat surface of the first wireless tag 38, which opposes to the antenna part 25.

In the image forming apparatus 1, when the image forming part 13 is attached to the chassis 2, and the ceiling plate 2A is closed, the antenna 67 of the antenna part 25 is opposed with the antenna 63 of the first wireless tag 38 in a sufficiently close place, and the antenna 63 of the second wireless tag 56 in a somewhat farther place than it (FIG. 5C). Thereby, the image forming apparatus 1 can perform a communication process in an extremely stable manner via an electromagnetic wave between the antenna 67 of the antenna part 25 and the antenna 63 of the first wireless tag 38.

As the result, the image forming apparatus 1 can significantly suppress the occurrence frequency of communication abnormality that tends to occur when the second wireless tag 56 is disposed between the antenna part 25 and the first wireless tag 38 of the development unit 21 as in Patent Document 1. Accompanying this, in the image forming apparatus 1, it is almost always possible to avoid a situation where despite having the development unit 21 attached, because communication abnormality occurred between it and the first wireless tag 38, the operation state becomes printing unavailable (FIG. 12, SP8), thus enhancing the availability.

On the other hand, in the image forming apparatus 1, because the first wireless tag 38 is positioned between the antenna part 25 and the second wireless tag 56, the occurrence probability of communication abnormality is higher between the antenna part 25 and the second wireless tag 56 than between the antenna part 25 and the first wireless tag 38. Also, in general, the toner cartridge 22 has a higher replacement frequency than the development unit 21, and also has a more strict demand to its cost. Therefore, cheaper parts are adopted for the second wireless tag 56 than for the first wireless tag 38, and as the result its performance declines, occasionally causing communication abnormality.

Then, the image forming apparatus 1 made it possible to perform printing even when proper communication could not be performed with the second wireless tag 56 of the toner cartridge 22 if the toner remaining amount in the toner storage chamber 41 (FIG. 2) detected by the toner remaining amount sensor 27 is sufficient (FIG. 12, SP6 and SP7).

Thereby, the image forming apparatus 1 can prevent the occurrence of a situation that the user cannot understand where despite having the toner cartridge 22 with a sufficient toner remaining amount attached, printing cannot be performed because communication abnormality occurred in the second wireless tag 56, and can enhance the availability.

From another viewpoint, in the image forming apparatus 1, a drive force is transmitted to the development unit 21 via cogwheels, etc. from the chassis 2 side to rotate the photosensitive drum 46, etc. Therefore, in the image forming apparatus 1, when normal communication cannot be performed with the first wireless tag 38, there is no guarantee that the proper development unit 21 is attached, and if a forcible performance of a print process is attempted in a state where a wrong development unit is attached, troubles such as a cogwheel damage, etc. could be generated. Therefore, in the image forming apparatus 1, a normal communication process is performed with the first wireless tag 38, and only if it is judged that the normal development unit 21 is attached by referring to the model category information, etc., the operation state is set to printing available (FIG. 12, SP4).

Also, in the image forming apparatus 1, if a sufficient amount of toner remains in the toner storage chamber 41 of the development unit 21, even if the toner cartridge 22 is not attached, there is an extremely low possibility of causing a print failure such as thin print and breakage of parts.

For such a reason as this, in the image forming apparatus 1, a higher priority was given to the establishment of communication between the antenna part 25 and the first wireless tag 38 of the development unit 21 than the establishment of communication between it and the second wireless tag 56 of the toner cartridge 22, thereby the opportunities where a print process can be performed can be greatly increased, and the availability can be significantly enhanced.

Further, the image forming apparatus 1 is designed so that part of the second wireless tag 56, specifically about a half of the range in the right-left direction is overlapped with the farther part of the first wireless tag 38 when viewed from the antenna part 25 side (that is, the rear side) while the remaining part is not overlapped but directly opposed with the antenna part 25 (FIGS. 5C and 9). Therefore, the image forming apparatus 1 can achieve miniaturization by suppressing the size of the antenna 67 in the antenna part 25 while performing fine wireless communication with the second wireless tag 56.

Especially, the image forming apparatus 1 is designed so that instead of separately attaching each of the development unit 21 and the toner cartridge 22 alone to the chassis 2, upon configuring the image forming part 13 by attaching the toner cartridge 22 to the development unit 21, the image forming part 13 is attached to the chassis 2. Therefore, in the image forming apparatus 1, the relative position between the first wireless tag 38 and the second wireless tag 56 can be adjusted with high precision, allowing a significant reduction in the possibility of occurrences of communication abnormality due to an interference, etc. in the wireless communication with the antenna part 25.

Also, the image forming apparatus 1 is designed so that the toner cartridge 22 is attached by sliding it leftward to the development unit 21 (FIGS. 5A and 5B). Therefore, in the image forming apparatus 1, even if the toner cartridge 22 is attached without sufficiently being pushed in leftward to the development unit 21, the second wireless tag 56 can be overlapped with the first wireless tag 38 in a manner slightly shifted rightward (FIG. 9), having no concern of generating communication abnormality due to an interference, etc. during wireless communication.

From another viewpoint, in the image forming apparatus 1, because the toner cartridge 22 is slid leftward to the development unit 21, after the heights of the first wireless tag 38 and the second wireless tag 56 are mostly aligned, the second wireless tag 56 is moved rightward. Therefore, in the image forming apparatus 1, the possibility that the second wireless tag 56 is shifted in the up-down direction relative to the first wireless tag 38 is low, thus there is no need to extend the height of the antenna part 25 in the up-down direction beyond the up-down direction lengths of the first wireless tag 38, etc., allowing relative miniaturization of the antenna part 25.

According to the configuration mentioned above, in the image forming apparatus 1 by the first embodiment, when each of the image forming parts 13 is attached to the chassis 2, the antenna part 25 is opposed with the first wireless tag 38 of the development unit 21 in a sufficiently close place and with the second wireless tag 56 of the toner cartridge 22 in a somewhat farther place than it (FIG. 5C). Thereby, the image forming apparatus 1 can perform a communication process in an extremely stable manner via an electromagnetic wave between the antenna 67 of the antenna part 25 and the antenna 63 of the first wireless tag 38, significantly reduce the possibility that a print process cannot be performed due to communication abnormality, and greatly enhance the availability.

2. Second Embodiment

In comparison with the image forming apparatus 1 by the first embodiment, although an image forming apparatus 101 (FIG. 1) by the second embodiment is different in comprising a control part 103, image forming parts 113, and toner remaining amount sensors 128 substituting for the control part 3, the image forming parts 13, and the toner remaining amount sensors 27, it is configured in the same manner in the other respects. Although the control part 103 comprises a CPU, a memory part, etc. inside in the same manner as the control part 3 by the first embodiment, it is designed to perform an operation state judgement process that is partially different from that in the first embodiment (the details are mentioned later).

Each of the image forming parts 113 (113K, 113Y, 113M, and 113C) comprises a development unit 121 and a toner cartridge 122 substituting for the development unit 21 and the toner cartridge 22 (FIGS. 2-6) of the image forming part 13 by the first embodiment. In the same manner as in the first embodiment, the development unit 121 has the first wireless tag 38 contained in the first tag holding part 37 (FIG. 3). Also, in the same manner as in the first embodiment, the toner cartridge 122 has the second wireless tag 56 contained in the second tag holding part 55 (FIG. 4).

Figure 13B:
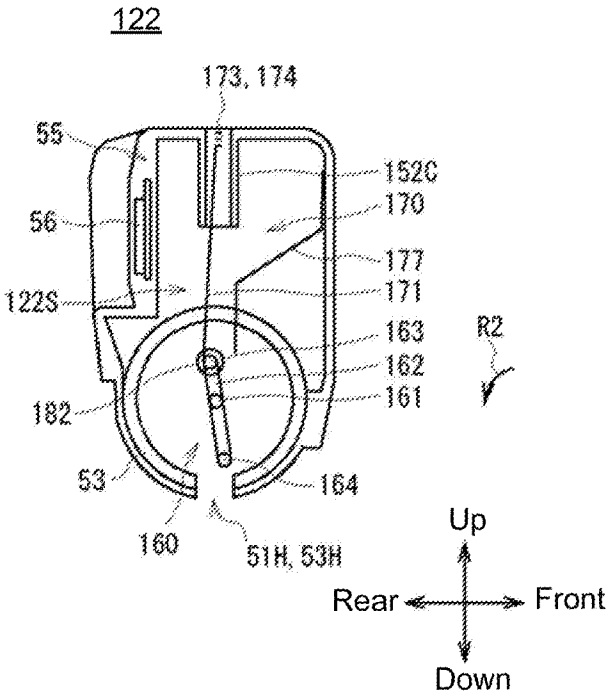
FIGS. 13A and 13B are schematic diagrams showing the configuration of a toner cartridge by the second embodiment.
Figure 13A:
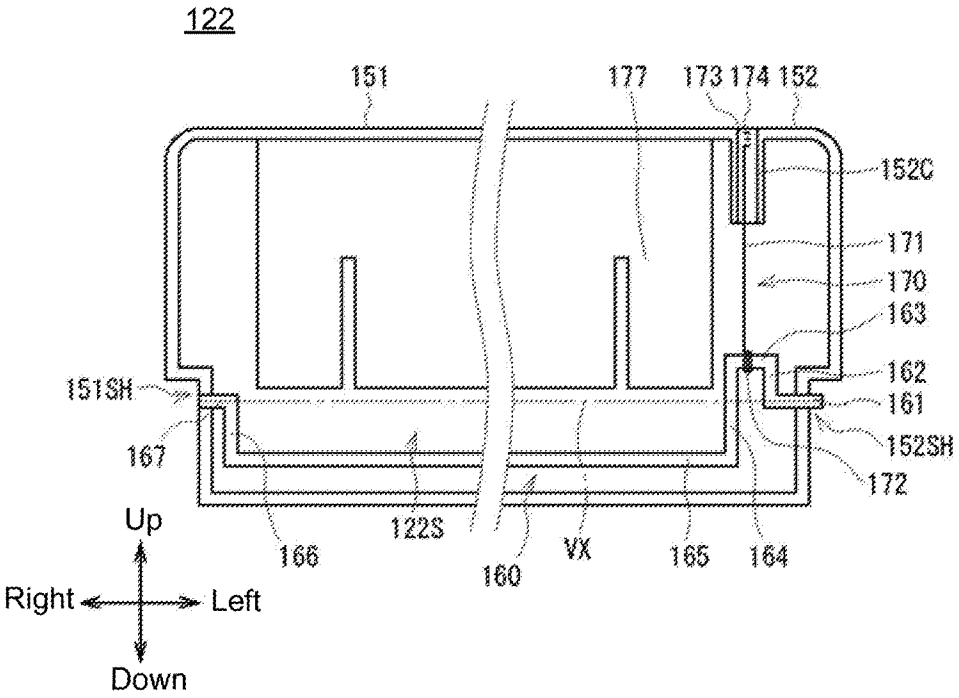

2-1. Configurations of the Toner Cartridge and the Toner Remaining Amount Sensor As its rear face view and the left side face view are schematically shown in FIGS. 13A and 13B, the toner cartridge 122 forms inside a toner containing space 122S with an outer frame 151 and a side frame 152 substituting for the outer frame 51 and the side frame 52 in the first embodiment (FIG. 4). Note that for the convenience of making the drawings, the semicylindrical opening/closing body 53 and the lever 54 are omitted in FIG. 13A.

Drilled on the lower part of the right side face of the outer frame 151 is a insertion hole 151SH made of a relatively small round hole. Also, drilled on the lower part of the left side face of the side frame 152 is an insertion hole 152SH made of a relatively small round hole in a place corresponding to the insertion hole 151SH in the front-rear direction and the up-down direction. For the convenience of explanation, below, a virtual line passing the center of the insertion hole 151SH and the center of the insertion hole 152SH is called a virtual axis VX.

Provided inside the outer frame 151, that is, in the lower part of the toner containing space 122S is a stirring shaft 160. The stirring shaft 160 has a configuration where a columnar member elongated as the whole along the right-left direction, that is, along the virtual axis VX, is bent in a crank shape.

Specifically, the stirring shaft 160 has a left shaft part 161 along the virtual axis VX at the left end, a left radiating part 162 that is connected to the right end of the left shaft part 161 and heads away from the virtual axis VX (hereafter, also called the radial direction), and a sensor crank part 163 formed parallel to the virtual axis VX from the end part of the left radiating part. Also, the stirring shaft 160 has a crank connection part 164 heading in the opposite direction from the right end of the sensor crank part 163 across the virtual axis VX, and a stirring crank part 165 that is nearly parallel with the virtual axis VX from the end part of the crank connection part 164 to the right end vicinity of the outer frame 151. Further, the stirring shaft 160 has a right radiating part 166 heading from the right end of the stirring crank part 165 toward the virtual axis VX, and a right shaft part 167 along the virtual axis VX.

This stirring shaft 160 has the left shaft part 161 inserted to the insertion hole 152SH of the side frame 152 and the right shaft part 167 inserted to the insertion hole 151SH of the outer frame 151, and thereby is held in a freely rotatable manner by the insertion holes 152SH and 151SH. Therefore, the stirring shaft 160 can freely rotate relative to the outer frame 151, etc.

Also, in the stirring shaft 160, because the stirring crank part 165 has a greater length (that is, longer) in the right-left direction than the sensor crank part 163, its weight is also greater. Also, in the stirring shaft 160, the stirring crank part 165 has a greater distance (farther) from the virtual axis VX than the sensor crank part 163. Further, in the stirring shaft 160, the sensor crank part 163 and the stirring crank part 165 are positioned in the opposite sides across the virtual axis VX.

Therefore, when no external force is acting, the stirring shaft 160 has a greater downward force due to the gravitational effect on the stirring crank part 165 than on the sensor crank part 163, rotates so as to move the stirring crank part 165 to the lowest point on the rotation path (hereafter called the lowest position), and attempts to remain still in this lowest position (FIG. 13).

Also, provided in the left end vicinity of the toner containing space 122S, that is, inside the side frame 152, is a sensor shaft 170 in a place that becomes mostly the upper side of the sensor crank part 163. The sensor shaft 170 is configured of an elongated columnar member made of stainless steel, for example, bent as necessary.

This sensor shaft 170 has a central part 171 occupying its major part formed in a linear shape mostly along the up-down direction. The lower end of the central part 171 is connected with a link part 172 wound annularly centering on a shaft along the right-left direction. The link part 172 is inserted to the sensor crank part 163 of the stirring shaft 160.

The upper end of the central part 171 is connected with a holding part 173 wound centering on a shaft along the up-down direction. This holding part 173 holds a magnet 174 by being wound around this magnet 174. Also, the upper end vicinity of the sensor shaft 170 is inserted to the interior of a guide part 152C erected in a downward cylindrical shape on the ceiling part of the side frame 152. Incidentally, the ceiling part of the guide part 152C is sealed with a predetermined sealing material, preventing the toner from leaking.

Because of such configuration, when the stirring shaft 160 rotates, because the link part 172 circles around the virtual axis VX together with the sensor crank part 163, the sensor shaft 170 can have the holding part 173 and the magnet 174 perform a piston movement in the up-down direction inside the guide part 152C. Incidentally, in the toner cartridge 122, because the lengths of individual parts of the stirring shaft 160, the position and the up-down direction length of the guide part 152C, etc. are appropriately set, the holding part 173 and the magnet 174 can be moved in the up-down direction while retaining them inside the guide part 152C.

Also, provided inside the outer frame 151 is a swing member 177 formed in a sheet shape that is thin in the front-rear direction. The swing member 177 is configured of a material having flexibility as the whole, and its upper end vicinity is attached to the upper end vicinity of the front plate of the outer frame 151. The up-down direction length and the attaching position of this swing member 177 are appropriately set so that its lower end part contacts with the stirring crank part 165 when the stirring shaft 160 is rotated in the arrow R2 direction (that is, anticlockwise) in FIG. 13B.

On the other hand, provided in the development unit 121 is a stirring shaft rotation part 180 inside the toner cartridge attaching part 35 on the right side face of the left side plate 31. The stirring shaft rotation part 180 has a pedestal 181 in a flat columnar shape directed rightward from the right side face of the left side plate 31.

Erected rightward near the center of the right side face of the pedestal 181 is a rotation part 182 in a columnar shape having a shorter diameter than the pedestal 181. Drilled on the center of the rotation part 182 is a shaft insertion hole 182H made of a round hole directed leftward. Formed on the right side face of the rotation part 182 is a protruding part 183 by a fan-shaped part occupying a range of about ¼ round of an annular part on the right side face protruding further rightward.

Also, the rotation part 182 has a cogwheel (not shown) attached inside the left side plate 31, and as necessary, it is engaged with cogwheels for rotating the photosensitive drum 46 (FIG. 2), etc. Thereby, once a drive force is transmitted from the chassis 2 side through the cogwheels (not shown), the rotation part 182 rotates at a relatively low speed in the arrow R2 direction that is the clockwise direction when viewed from the right side, that is, the anticlockwise direction when viewed from the left side.

Figure 15A:
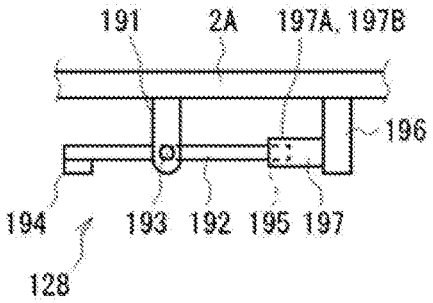
FIGS. 15A-15C are schematic diagrams showing the configuration of a toner remaining amount sensor by the second embodiment.
Figure 15C:
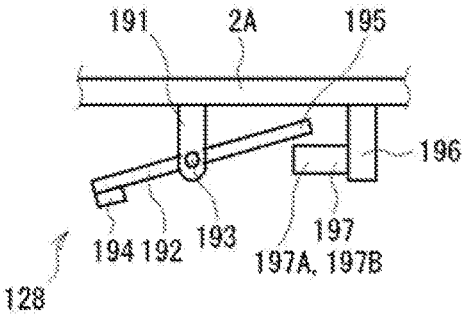
Figure 15B:
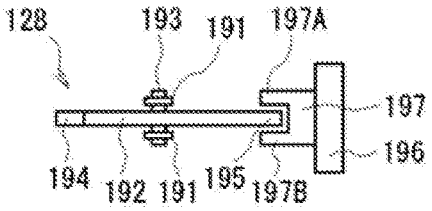

Further, provided on the lower face of the ceiling plate 2A of the chassis 2 of the image forming apparatus 101 (FIG. 1) are toner remaining amount sensors 128 shown in FIGS. 15A and 15B in places immediately above the image forming parts 113, respectively. Incidentally, FIGS. 15A and 15B schematically show the left face view and the bottom view, respectively.

The toner remaining amount sensor 128 as a remaining amount detection part has a configuration where two pieces of rotation supporting bodies 191 erected downward from the lower face of the ceiling plate 2A and a rotating body 192 formed thinly elongated along the front-rear direction are penetrated in the right-left direction by a rotation shaft 193. Therefore, the rotating body 192 can freely rotate relative to the rotation supporting bodies 191 with the rotation shaft 193 as its rotation center. Also, attached to the rear end vicinity on the lower face of the rotating body 192 is a magnet 194.

That is, when no external force is especially applied, as shown in FIG. 15A, the toner remaining amount sensor 128 orients the rotating body 192 nearly horizontally and positions the front end part 195 at the same height as other parts. Also, in the toner remaining amount sensor 128, when a magnet of the opposite polarity is positioned below the magnet 194 for example, a downward force (that is, an attractive force) acts on the magnet 194, and as shown in FIG. 15C, it makes the rotating body 192 inclined from the horizontal direction and lifts the front end part 195 upward. Incidentally, once the downward attractive force stops acting on the magnet 194, the toner remaining amount sensor 128 returns to the state shown in FIG. 15A due to the actions by a bias member and a stopper that are not shown.

Also, in the rear end vicinity of the rotating body 192, an optical sensor 197 is attached to the lower face of the ceiling plate 2A via a mount 196. This optical sensor 197 emits detection light rightward from a light emitting part 197A on the left side, receives this detection light by a light receiving part 197B on the right side, generates a received light signal that expresses the amount of light obtained at this time as a signal level, and sends it to the control part 103 (FIGS. 1 and 11).

For example, as shown in FIG. 15A, when the rotating body 192 is oriented nearly horizontally, that is, when no attractive force is acting on the magnet 194, because the detection light from the light emitting part 197A is blocked by the front end part 195, the optical sensor 197 cannot receive this detection light at the light receiving part 197B. Hereafter, such a state as this in the toner remaining amount sensor 128 is called a light blocked state. At this time, the signal level of the received light signal becomes relatively low.

Also, as shown in FIG. 15C, when the rotating body 192 is inclined from the horizontal direction, that is, when an attractive force is acting on the magnet 194, because the detection light from the light emitting part 197A reaches the light receiving part 197B without being blocked, this detection light can be received. Hereafter, such a state as this in the toner remaining amount sensor 128 is called a light receiving state. At this time, the signal level of the received light signal becomes relatively high.

Therefore, based on the received light signal obtained from the toner remaining amount sensor 128, the control part 103 can judge whether an attractive force is acting on the magnet 194.

2-2. Detection of the Amount of Remaining Toner by the Toner Remaining Amount Sensor Next, explained is the mechanism for detecting the amount of remaining toner inside the toner cartridge 122 by the toner remaining amount sensor 128.

Figure 14:
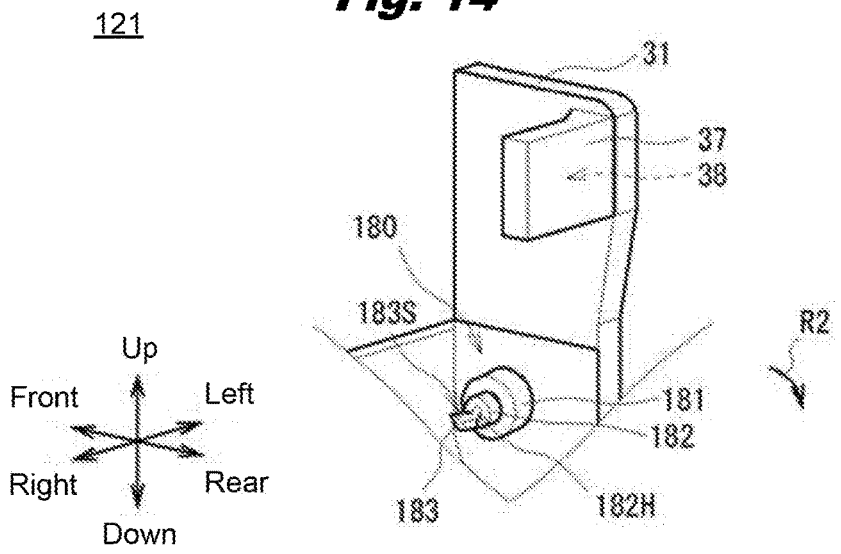
FIG. 14 is a schematic perspective diagram showing the configuration of a development unit by the second embodiment.
Figure 16C:
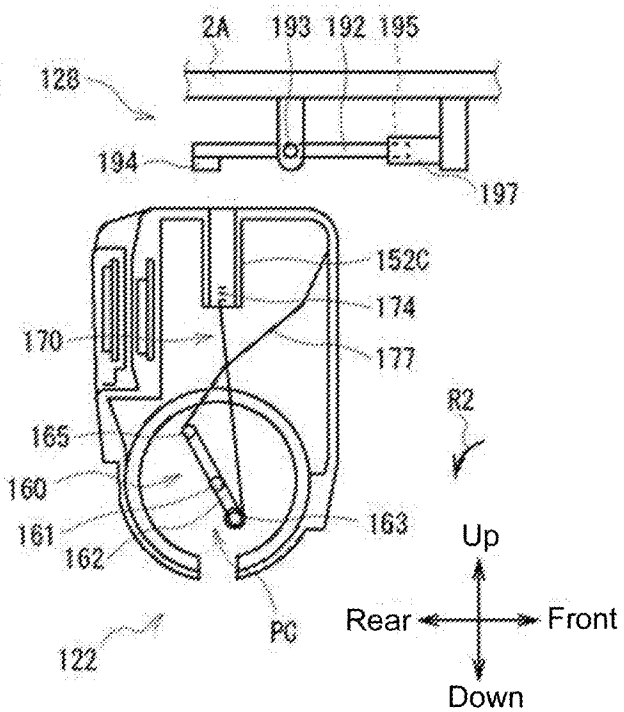
FIGS. 16A-16C are schematic diagrams showing the relation between the rotation of a stirring shaft and the toner remaining amount sensor.
Figure 16B:
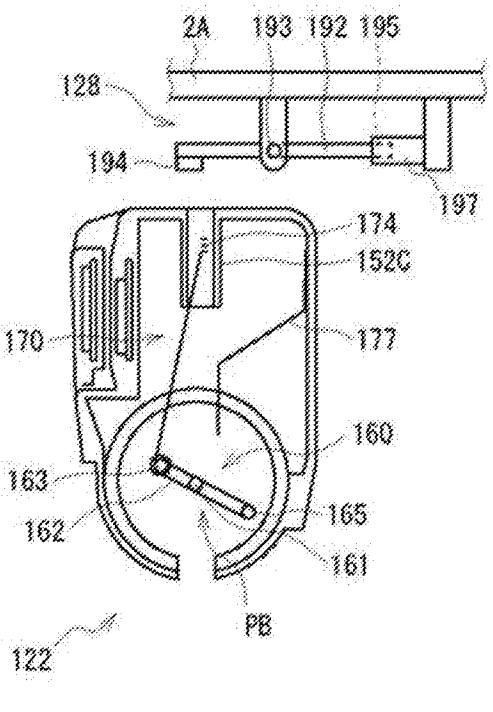
Figure 16A:
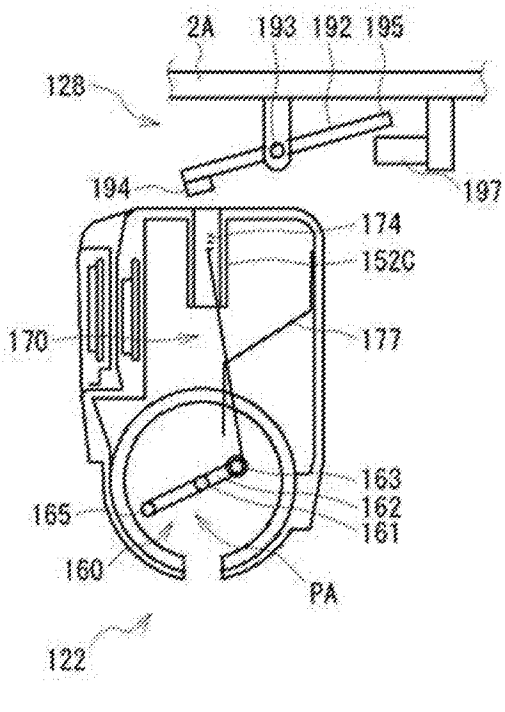

FIGS. 16A-16C all show states where one of the image forming parts 113 is attached to the chassis 2 of the image forming apparatus 101, and the ceiling plate 2A is closed. In the image forming part 113, once the toner cartridge 122 is attached to the development unit 121, the stirring shaft 160 inserts the left shaft part 161 to the shaft insertion hole 182H provided on the rotation part 182 of the stirring shaft rotation part 180 (FIG. 14).

Therefore, once the rotation part 182 of the stirring shaft rotation part 180 rotates in the arrow R2 direction, the leading side face 183S of the protruding part 183 contacts with the left radiating part 162 (FIG. 13), and a force in the arrow R2 direction from the leading side face 183S is applied to the stirring shaft 160. Incidentally, the rotation part 182 rotates in the arrow R2 direction at a relatively low rotation speed based on a drive force supplied from the chassis 2 side.

As shown in FIG. 16A, once rotated in the arrow R2 direction, the stirring shaft 160 comes into a state where the sensor crank part 163 is positioned somewhat in the upper side in the front of the left shaft part 161, and the magnet 174 is positioned at a relatively high level inside the guide part 152C by the sensor shaft 170. At this time, because the magnet 194 is attracted by the magnet 174 making the rotating body 192 inclined from the horizontal direction, the toner remaining amount sensor 128 comes into the light receiving state. Hereafter, the attitude of the stirring shaft 160 at this time is called a light reception starting attitude PA.

Also, when the stirring shaft 160 continues to be rotated in the arrow R2 direction, the magnet 174 continues to be raised inside the guide part 152C by the sensor shaft 170, and after having reached the top dead center, it is lowered. Meanwhile, the toner remaining amount sensor 128 maintains the light receiving state.

Further, when the stirring shaft 160 continues to be rotated in the arrow R2 direction, as shown in FIG. 16B, it comes into a state where the sensor crank part 163 is positioned somewhat in the upper side in the rear of the left shaft part 161, and the magnet 174 is moved away to a certain degree from the top dead center inside the guide part 152C. At this time, because the magnet 194 stops to be attracted by the magnet 174, the toner remaining amount sensor 128 transitions to the light blocked state. The attitude of the stirring shaft 160 at this time is called a light reception ending attitude PB.

That is, the toner remaining amount sensor 128 comes into the light receiving state by the time the stirring shaft 160 rotates in the arrow R2 direction and changes its attitude from the light reception starting attitude PA (FIG. 16A) to the light reception ending attitude PB (FIG. 16B), and comes into the light blocked state by the time the attitude of the stirring shaft 160 changes from the light reception ending attitude PB (FIG. 16B) to the light reception starting attitude PA (FIG. 16A).

Here, as seen in FIGS. 16A and 16B, the rotation angle from the light reception starting attitude PA to the light reception ending attitude PB of the stirring shaft 160 is smaller than 180 degrees. Therefore, if the stirring shaft 160 is fixed to the rotation part 182 of the stirring shaft rotation part 180 (FIG. 14) and rotates at a relatively low speed together with the rotation part 182, as shown in FIG. 17A, the received light signal obtained from the toner remaining amount sensor 128 forms a rectangular wave that varies periodically so that the period of a low level is longer than the period of a high level. Incidentally, a cycle T indicates a period during which the rotation part 182 performs one rotation.

By the way, if the actual stirring shaft 160 continues to rotate at a relatively low speed in the arrow R2 direction from the state shown in FIG. 16B by a force received from the rotation part 182 of the stirring shaft rotation part 180 (FIG. 14), in due course, the stirring crank part 165 contacts with the lower end vicinity of the swing member 177 and continues to press the lower part of the swing member 177 toward the rear and slightly upward. At this time, because a friction force with the swing member 177 is acting even after reaching the highest place (that is, the top dead center), the stirring crank part 165 does not make a free fall but continues to have the left radiating part 162 contact with the leading side face 183S of the protruding part 183.

In due course, as shown in FIG. 16C, once the stirring crank part 165 leaves the swing member 177, the stirring shaft 160 tries to fall down due to the gravitational effect, and trying to rotate at a high speed in the arrow R2 direction, that is, a faster speed than the rotation speed of the rotation part 182, takes the left radiating part 162 away from the leading side face 183S of the protruding part 183. In other words, while falling down, the stirring shaft 160 rotates in the arrow R2 direction ahead of the rotation part 182 of the stirring shaft rotation part 180.

Incidentally, in the state shown in FIG. 16C, the sensor crank part 163 of the stirring shaft 160 is positioned at a relatively low level, and the magnet 174 is also positioned at a relatively low level, therefore the toner remaining amount sensor 128 is in the light blocked state. Also, hereafter, the attitude of the stirring shaft 160 at this time is called a fall starting attitude PC.

In due course, once the stirring crank part 165 reaches the upper face of the toner contained inside the toner cartridge 122, because the toner becomes a resistance, the stirring shaft 160 stops rotating in the arrow R2 direction. Afterward, once the leading side face 183S of the protruding part 183 of the stirring shaft rotation part 180 catches up and contacts with the left radiating part 162, the stirring shaft 160 resumes rotation in the arrow R2 direction while having the stirring crank part 165 dive into the toner.

Figure 18A:
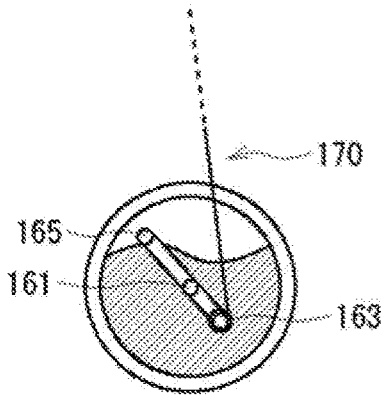
FIGS. 18A and 18B are schematic diagrams showing the relation between the toner remaining amount and the attitude of the stirring shaft.

Here, in the toner cartridge 122, as shown in FIG. 18A for example, if the toner remaining amount is relatively large, at the time when the stirring crank part 165 has reached the upper face of the toner, the sensor crank part 163 is positioned at a relatively low level, and the magnet 174 is also positioned at a relatively low level, therefore the toner remaining amount sensor 128 maintains the light blocked state (FIG. 15A). In other words, the stirring shaft 160 has not transitioned to the light reception starting attitude PA (FIG. 16A), yet.

In this case, in the toner cartridge 122, when a relatively short time has passed after the stirring crank part 165 reached the upper face of the toner, the leading side face 183S of the protruding part 183 of the stirring shaft rotation part 180 catches up and contacts with the left radiating part 162, rotates the stirring shaft 160 at a relatively low speed in the arrow R2 direction, and in due course, transitions to the light reception starting attitude PA. That is, the stirring shaft 160 takes a relatively long time until transitioning to the light reception starting attitude PA after becoming the fall starting attitude PC.

At this time, the received light signal generated by the toner remaining amount sensor 128 varies as shown in FIG. 17B. As seen in this FIG. 17B, if the toner remaining amount is relatively large, a period T1 when the received light signal of the toner remaining amount sensor 128 is at the high level is relatively short, specifically shorter than ½ of the cycle T.

Figure 18B:
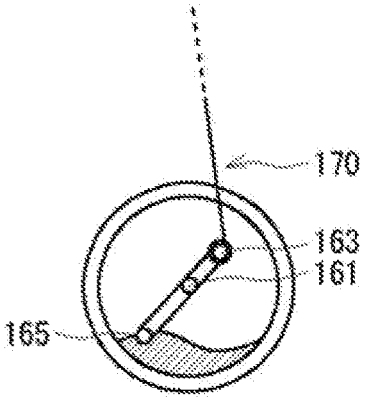

On the other hand, in the toner cartridge 122, as shown in FIG. 18B for example, if the toner remaining amount is relatively small, at the time when the stirring crank part 165 has reached the upper face of the toner, the sensor crank part 163 is positioned at a relatively high level, and the magnet 174 is also positioned at a relatively high level, therefore the toner remaining amount sensor 128 has transitioned from the light blocked state to the light receiving state (FIG. 15B). In other words, the stirring shaft 160 has immediately transitioned from the fall starting attitude PC (FIG. 16C) to the light reception starting attitude PA (FIG. 16A). In this case, in the toner cartridge 122, when a relatively long time has passed after the stirring crank part 165 reached the upper face of the toner, the leading side face 183S of the protruding part 183 of the stirring shaft rotation part 180 catches up and contacts with the left radiating part 162, and rotates the stirring shaft 160 at a relatively low speed in the arrow R2 direction.

Therefore, the received light signal generated by the toner remaining amount sensor 128 varies through the passage of time as shown in FIG. 17C. As seen in this FIG. 17C, if the toner remaining amount is relatively small, a period T2 when the received light signal of the toner remaining amount sensor 128 is at the high level is relatively long, specifically longer than ½ of the cycle T.

Considering such a relation as this, in the control part 103, by setting a threshold value to ½ of the cycle T and comparing the period when the received light signal obtained from the toner remaining amount sensor 128 is at the high level with this threshold value, if this period is equal to or above the threshold value, the toner remaining amount can be judged as relatively large, and if it is below the threshold value, the toner remaining amount can be judged as relatively small.

Also, in the control part 103, if the image forming part 113 is normally attached, because the rotation part 182 of the stirring shaft rotation part 180 is rotated by supplying a drive force to the development unit 121, regardless of the toner remaining amount, the received light signal obtained from the toner remaining amount sensor 128 varies periodically. Therefore, if no periodic variation appears in the received light signal obtained from the toner remaining sensor 128 although the drive force is supplied to the development unit 121, because the stirring shaft 160 is not rotating, the control part 103 can judge that the toner cartridge 122 is not attached to the development unit 121.

In this manner, based on the received light signal obtained from the toner remaining amount sensor 128, the control part 103 can detect the amount of remaining toner in the toner cartridge 122, and can also judge whether the toner cartridge 122 is attached to the development unit 121.

2-3. Operation State Judgement Process

Next, explained is the operation state judgement process in this second embodiment. The control part 103 of the image forming apparatus 101 is designed to perform an operation state judgement routine RT2 shown in FIG. 19 that corresponds to FIG. 12.

Specifically, upon starting the operation state judgement routine RT2, the control part 103 performs the same processes in SP11-SP14 as in SP1-SP4 of the operation state judgement routine RT1 (FIG. 12), and if a negative result is obtained in SP13, moves on to the next SP15. It indicates that, in the same manner as in the case where a negative result was obtained in SP3, because information could not be read from the memory part of the second wireless tag 56, there is a possibility that the toner cartridge 122 is not attached or that communication abnormality, etc. occurred although the toner cartridge 122 is attached.

In SP15, the control part 103 obtains the received light signal as the detection result from the toner remaining amount sensor 128, and moves on to the next SP16. In SP16, the control part 103 judges whether the received light signal is varying periodically. If a positive result is obtained here, it indicates that although the toner cartridge 122 is attached, communication abnormality occurred between it and the second wireless tag 56. At this time, the control part 103 moves on to the next SP17.

In SP17, the control part 103 judges whether the toner remaining amount is sufficient, that is whether the length of the period when the received light signal obtained from the toner remaining amount sensor 128 is at the high level is shorter than the threshold (½ of the cycle T). If a positive result is obtained here, it indicates that a sufficient amount of toner is contained in the toner cartridge 122 and that a normal print process can be performed. At this time, the control part 103 moves on to the next SP18, displays a notice in the same manner as in SP7 of the operation state judgement routine RT1 (FIG. 12), sets the operation state that can perform a print process, and moves on to the next SP20, ending the operation state judgement routine RT2.

On the other hand, if a negative result is obtained in SP16, it indicates that because the toner cartridge 122 is not attached, a normal print process cannot be performed. At this time, the control part 103 moves on to the next SP19. Also, if a negative result is obtained in SP17, it indicates although the toner cartridge 122 is attached, because the toner remaining amount is small, a normal print process cannot be performed. At this time, the control part 103 moves on to the next SP19.

In SP19, the control part 103 displays an error in the same manner as in SP8 of the operation state judgement routine RT1 (FIG. 12), sets the operation state that cannot perform a print process, and moves on to the next SP20, ending the operation state judgement routine RT2.

2-4. Effects, etc.

In the configuration mentioned above, the image forming apparatus 101 by the second embodiment is designed, in the same manner as in the first embodiment, so that when the image forming part 113 is configured by attaching the toner cartridge 122 to the development unit 121, the first wireless tag 38 is positioned in the rear side of the second wireless tag 56 (FIG. 5B), and they are partially overlapped when viewed from the rear (FIG. 9).

In the image forming apparatus 101, when the image forming part 113 is attached to the chassis 2, and the ceiling plate 2A is closed, in the same manner as in the first embodiment again, the antenna part 25 is opposed with the first wireless tag 38 in a sufficiently close place and the second wireless tag 56 in a somewhat farther place than it (FIG. 5C). Thereby, the image forming apparatus 101 can perform a communication process via an electromagnetic wave in an extremely stable manner between the antenna part 25 and the first wireless tag 38.

Figure 17:
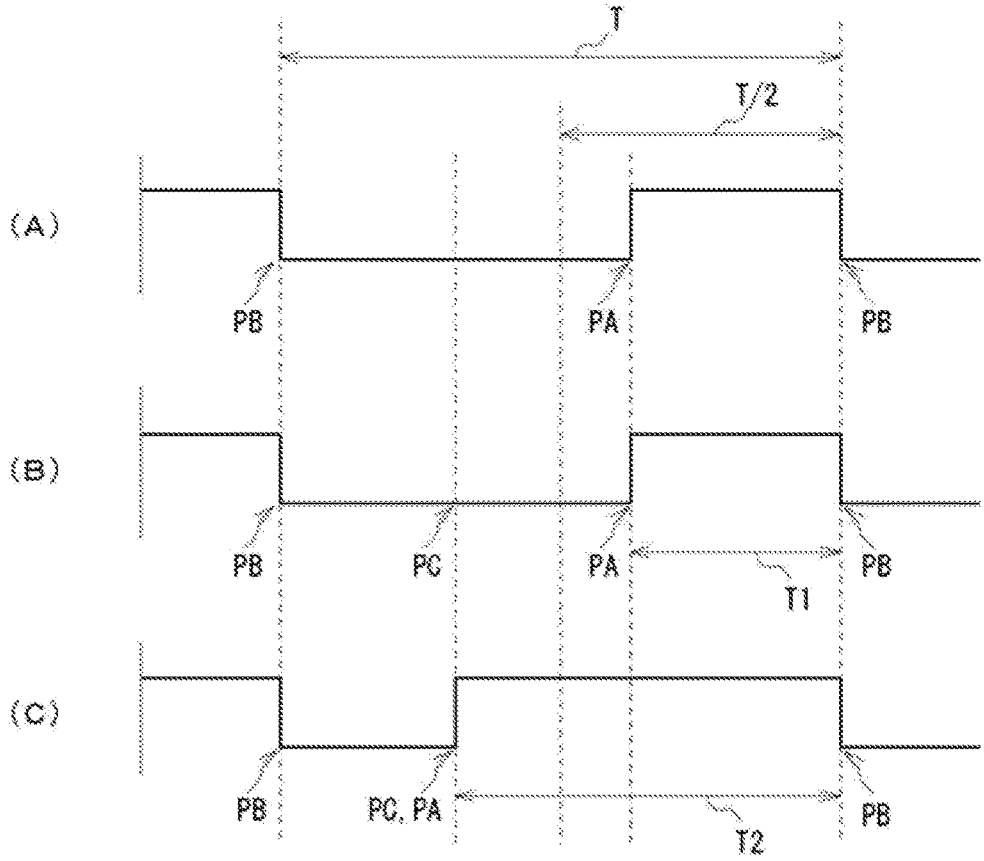
FIG. 17 is a schematic diagram showing the variation of a detection signal according to the toner remaining amount.

Further, the image forming apparatus 101 is designed so that in the toner remaining amount sensor 128, the length of the period when the received light signal is at the high level varies according to the toner remaining amount, and the received light signal varies periodically regardless of the toner remaining amount (FIG. 17).

Figure 19:
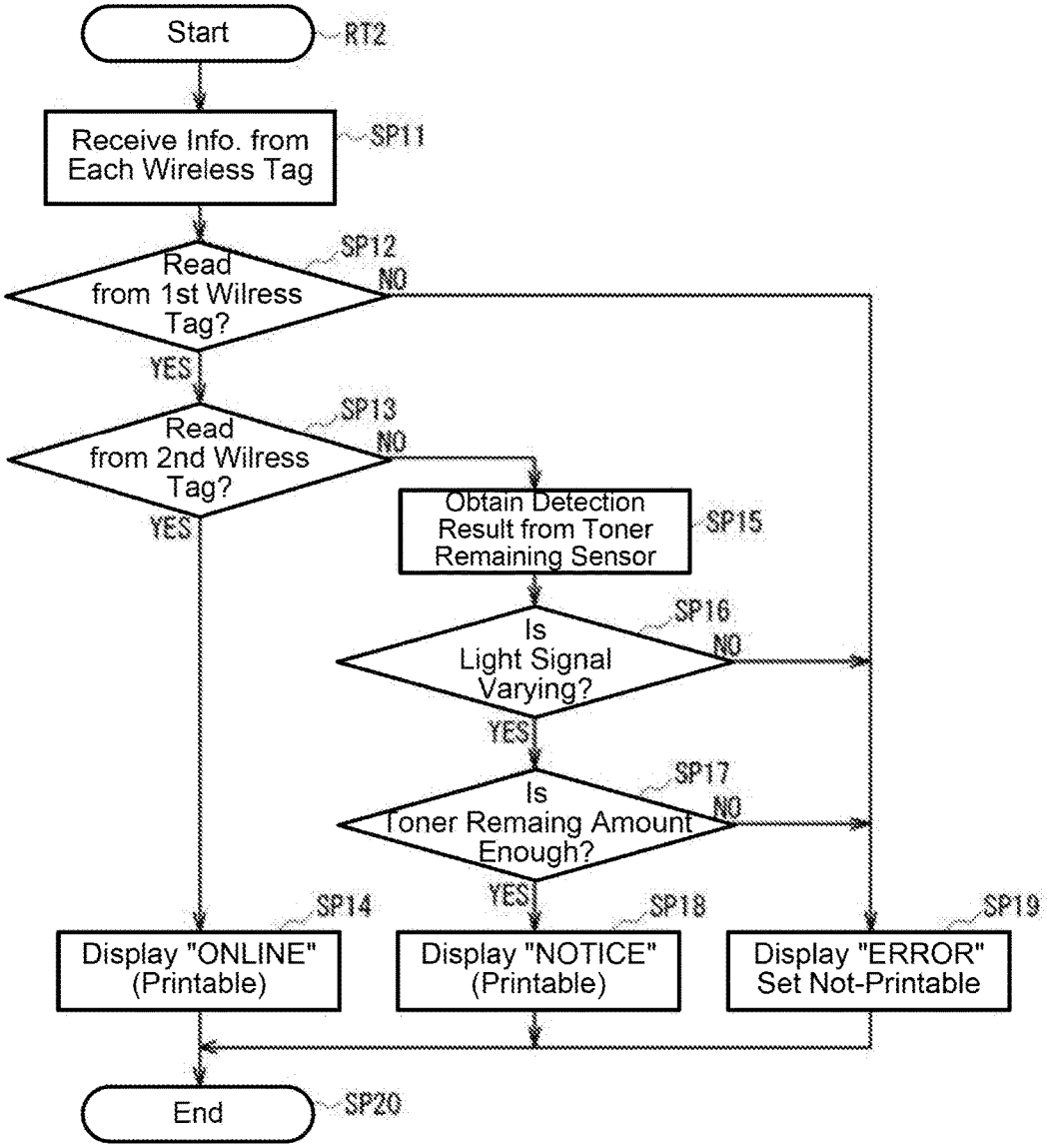
FIG. 19 is a flow chart showing an operation state judgement routine by the second embodiment.

Therefore, in the image forming apparatus 101, by judging whether the received light signal obtained from the toner remaining amount sensor 128 varies periodically, it can be judged whether the toner cartridge 122 is attached (FIG. 19, SP16). That is, in the image forming apparatus 101, even if normal communication could not be performed between the antenna part 25 and the second wireless tag 56, if the received light signal obtained from the toner remaining amount sensor 128 is varying periodically, it can be judged that the toner cartridge 122 is attached.

Further, in the image forming apparatus 101, because the remaining amount of toner in the toner cartridge 122 can be detected based on the received light signal obtained from the toner cartridge 122, the operation state can be switched according to the toner remaining amount.

In other respects also, the image forming apparatus 101 by the second embodiment can achieve the same actions and effects as in the first embodiment.

According to the configuration mentioned above, in the image forming apparatus 101 by the second embodiment, when the image forming part 113 is attached to the chassis 2, the antenna part 25 is opposed with the first wireless tag 38 of the development unit 121 in a sufficiently close place and with the second wireless tag 56 of the toner cartridge 122 in a somewhat farther place than it (FIG. 5C). Thereby, the image forming apparatus 101 can perform a communication process in an extremely stable manner via an electromagnetic wave between the antenna part 25 and the first wireless tag 38, significantly reduce the possibility that a print process cannot be performed due to communication abnormality, and greatly enhance the availability. Further, even if normal communication could not be performed between the antenna part 25 and the second wireless tag 56, in the image forming apparatus 101 can judge the presence/absence of the toner cartridge 122 based on the received light signal obtained from the toner remaining amount sensor 128 and appropriately set the operation state.

3. Other Embodiments

Stated in the first embodiment mentioned above was a case where the first wireless tag 38 and the second wireless tag 56 were overlapped in a state where they are shifted in the right-left direction (FIGS. 5B and 9). However, this invention is not limited to this, but the first wireless tag 38 and the second wireless tag 56 can be overlapped in a state where they are shifted in various kinds of directions such as the up-down direction and oblique directions for example. In short, the antenna part 25 only needs to oppose directly part of the second wireless tag 56 positioned farther to allow stable wireless communication, and the remaining part only needs to be overlapped with the first wireless tag 38 to contribute to the miniaturization of the antenna part 25. The same is true also for the second embodiment.

Also, stated in the first embodiment was a case where the first wireless tag 38 and the second wireless tag 56 were disposed so that about a half of their ranges overlap when viewed from the rear (FIG. 9). However, this invention is not limited to this, but the range where the first wireless tag 38 and the second wireless tag 56 overlap when viewed from the rear can be made less than a half or more than a half, or they can totally overlap with each other (over the whole range). Alternatively, the first wireless tag 38 and the second wireless tag 56 can be disposed adjacent to each other with almost no overlap when viewed from the rear. In any of those cases, because the first wireless tag 38 is disposed in a closer position than the second wireless tag 56 is to the antenna part 25, wireless communication with the first wireless tag 38 can be stably performed.

Further, stated in the above-mentioned first embodiment was a case where the second tag holding part 55 was disposed on the left side of the rear face of the toner cartridge 22 (FIG. 4), and the first tag holding part 37 protruded rightward from the right side face of the left side plate 31 of the development unit 21 (FIG. 3). However, this invention is not limited to this, but the second tag holding part 55 can be disposed on the left side face of the toner cartridge 22 for example, and the first tag holding part 37 can also be disposed embedded in the left side plate 31. In this case, the antenna part 25 can be positioned on the left side of the left side plate 31. In short, the second tag holding part 55 can be disposed in various kinds of places of the toner cartridge 22, and the first tag holding part 37 can be disposed in various kinds of places of the development unit 21. In these cases, the antenna part 25 only needs to be opposed with the first wireless tag 38 and the second wireless tag in a state where they partially overlap with each other. The same is true also for the second embodiment.

Further, stated in the above-mentioned first embodiment was a case where used as the operation power source was power generated by the IC chip 62 (FIG. 7) of each of the first wireless tag 38 and the second wireless tag 56 receiving an electromagnetic wave at the antenna 63. However, this invention is not limited to this, but it can be arranged, for example, so that the IC chip 62 of each of the first wireless tag 38 and the second wireless tag 56 operates using power supplied from the chassis 2 side as its power source. The same is true also for the second embodiment.

Further, stated in the above-mentioned first embodiment was a case where, when normal wireless communication could not be performed between the antenna part 25 and the second wireless tag 56 of the toner cartridge 22, if the remaining amount of toner in the toner storage chamber 41 (FIG. 2) detected by the toner remaining amount sensor 27 is sufficient, the operation state is set to printing available (FIG. 12, SP4). However, this invention is not limited to this, but when normal wireless communication could not be performed between the antenna part 25 and the second wireless tag 56, for example, the operation state can be immediately set to printing unavailable.

Further, stated in the above-mentioned first embodiment was a case where the toner remaining amount was detected utilizing the optical sensor to detect the rotation state of the detection body in the toner stored amount detection part 42. However, this invention is not limited to this, but the toner remaining amount can be detected utilizing various kinds of sensors. The same is true also for the second embodiment.

Further, stated in the above-mentioned embodiments were cases where this invention was applied to the image forming apparatus 1 configured as a so-called printer. However, this invention is not limited to this, it can be applied to various kinds of electronic equipment that perform printing by transferring and fusing a toner image to a sheet of paper as a medium utilizing an electrophotographic system, such as a facsimile machine, a copier, or a multifunction peripheral that combines these functions.

Further, this invention is not limited to the embodiments and the other embodiments mentioned above. That is, the scope of application of this invention also covers an embodiment that arbitrarily combines part or the whole of the above-mentioned embodiments and the above-mentioned other embodiments, and an embodiment that extracts part of them.

Further, stated in the above-mentioned first embodiment was a case where the image forming apparatus 1 as the image forming apparatus comprised the toner cartridge 22 as a developer cartridge, the first wireless tag 38 as a first wireless communication part, the first tag holding part 37 as a first holding part, the development unit 21 as a development unit, the second wireless tag 56 as a second wireless communication part, the second tag holding part 55 as a second holding part, and the antenna part 25 as an antenna part. However, this invention is not limited to this, but the image forming apparatus can comprise a developer cartridge, a first wireless communication part, a first holding part, a development unit, a second wireless communication part, a second holding part, and an antenna part having other various kinds of configurations.

This invention can be utilized by a printer that prints an image on a sheet of paper using an electrophotographic system for example.

1, 101: Image forming apparatus
2: Chassis
2A: Ceiling plate
3, 103: Control part
13, 113: Image forming part
14: Head holders
19: Display part
21, 121: Development unit
22, 122: Toner cartridge
22S, 122S: Toner containing space
23: LED head
25: Antenna part
26: Wireless controller
27, 128: Toner remaining amount sensor
31: Left side plate
32: Right side plate
33: Upper frame
34: Base frame
37: First tag holding part
37S: Containing space
38: First wireless tag
39: Tag holding lid body
41: Toner storage chamber
42: Toner stored amount detection part
51, 151: Outer frame
52, 152: Side frame
55: Second tag holding part
55S: Containing space
56: Second wireless tag
57: Tag holding lid body
61: Board
62: IC chip
63: Antenna
65: Base body 65
66: Interface connector
67: Antenna
160: Stirring shaft
170: Sensor shaft
177: Swing member
180: Stirring shaft rotation part
197: Optical sensor
M1, M2: Information tables
P: Sheet

What is claimed is:

1. An image forming apparatus, comprising:

a development unit that generates a toner image with a developer, a first wireless communication part that is connected to a first memory part storing information on the development unit, a first holding part that is provided on the development unit and holds the first wireless communication part, a developer cartridge that is detachable from the development unit, contains the developer, and supplies the developer to the development unit, a second wireless communication part that is connected to a second memory part storing information on the developer cartridge, a second holding part that is provided on the developer cartridge and holds the second wireless communication part, and an antenna part that communicates with the first and second wireless communication parts, wherein when the first and second wireless communication parts are respectively accommodated in the first and second holding parts, the developer cartridge is attached to the developer unit, and the development unit is installed in a predetermined installation place that is in the image forming apparatus, the first wireless communication part is closer to the antenna part than the second wireless communication part is, the second wireless communication part and the first wireless communication part oppose each other, the development unit is provided with a developer storage chamber in which the developer supplied from the developer cartridge is contained, the image forming apparatus includes a remaining amount detection part that detects a remaining amount of the developer contained in the developer storage chamber, and the image forming apparatus is provided with a control part that performs image formation if the remaining amount detection part detects that the remaining amount of the developer is equal to or above a predetermined threshold value when wireless communication between the antenna part and the second wireless communication part is not normally performed.

2. The image forming apparatus according to claim 1, further comprising:

the control part that is positioned outside the development unit and performs image formation with the development unit, the antenna part communicating with the control part, wherein the first and second wireless communication parts have antennas, the antennas are in a film shape, and when the developer unit and the developer cartridge are in the installation place, the antennas are arranged in parallel.

3. The image forming apparatus according to claim 1, wherein the first holding part holds the first wireless communication part in a position where part of the first wireless communication part does not overlap with the second wireless communication part when viewed from the antenna part.

4. The image forming apparatus according to claim 1, wherein each of the first wireless communication part and the second wireless communication part has an antenna and operates using, as its power source, power generated when an electromagnetic wave radiated from the antenna part is received by the antenna.

5. The image forming apparatus according to claim 1, further comprising:

a display part, wherein the control part displays a predetermined notice on the display part if the remaining amount detection part detects that the remaining amount of the developer is equal to or above the predetermined threshold value when the wireless communication between the antenna part and the second wireless communication part is not be normally performed.

6. The image forming apparatus according to claim 1, wherein the control part does not perform the image formation if the remaining amount detection part detects that the remaining amount of the developer is below the predetermined threshold value when the wireless communication between the antenna part and the second wireless communication part is not normally performed.

7. The image forming apparatus according to claim 6, further comprising:

a display part, wherein the control part displays a predetermined notice on the display part if the remaining amount detection part detects that the remaining amount of the developer is below the predetermined threshold value when the wireless communication between the antenna part and the second wireless communication part is not normally performed.

8. An image forming apparatus, comprising:

a development unit that generates a toner image with a developer, a first wireless communication part that is connected to a first memory part storing information on the development unit, a first holding part that is provided on the development unit and holds the first wireless communication part, a developer cartridge that is detachable from the development unit, contains the developer, and supplies the developer to the development unit, a second wireless communication part that is connected to a second memory part storing information on the developer cartridge, a second holding part that is provided on the developer cartridge and holds the second wireless communication part, an antenna part that communicates with the first and second wireless communication parts, a remaining amount detection part that detects a remaining amount of the developer contained in the developer cartridge, and a control part that performs image formation if the remaining amount detection part detects that the remaining amount of the developer is equal to or above a predetermined threshold value when wireless communication between the antenna part and the second wireless communication part is not normally performed, wherein when the first and second wireless communication parts are respectively accommodated in the first and second holding parts, the developer cartridge is attached to the developer unit, and the development unit is installed in a predetermined installation place that is in the image forming apparatus, the first wireless communication part is closer to the antenna part than the second wireless communication part is, and the second wireless communication part and the first wireless communication part oppose each other.

9. The image forming apparatus according to claim 8, further comprising:

a display part, wherein the control part displays a predetermined notice on the display part if the remaining amount detection part detects that the remaining amount of the developer is equal to or above the predetermined threshold value when the wireless communication between the antenna part and the second wireless communication part is not normally performed.

10. The image forming apparatus according to claim 8, wherein the control part does not perform the image formation if the remaining amount detection part detects that the remaining amount of the developer is below the predetermined threshold value when the wireless communication between the antenna part and the second wireless communication part is not normally performed.

11. The image forming apparatus according to claim 10, further comprising:

a display part, wherein the control part displays a predetermined notice on the display part if the remaining amount detection part detects that the remaining amount of the developer is below the predetermined threshold value when the wireless communication between the antenna part and the second wireless communication part is not normally performed.

12. The image forming apparatus according to claim 8, wherein the remaining amount detection part detects the remaining amount of the developer held by the developer cartridge based on a signal that shows periodic variation, and if the periodic variation does not appear in the signal, the control part judges that the developer cartridge is not attached.

13. The image forming apparatus according to claim 8, further comprising:

the control part that is positioned outside the development unit and performs image formation with the development unit, the antenna part communicating with the control part, wherein the first and second wireless communication parts have antennas, the antennas are in a film shape, and when the developer unit and the developer cartridge are in the installation place, the antennas are arranged in parallel.

14. The image forming apparatus according to claim 8, wherein the first holding part holds the first wireless communication part in a position where part of the first wireless communication part does not overlap with the second wireless communication part when viewed from the antenna part.

15. The image forming apparatus according to claim 8, wherein each of the first wireless communication part and the second wireless communication part has an antenna and operates using, as its power source, power generated when an electromagnetic wave radiated from the antenna part is received by the antenna.

* * * * *